US008277226B2

(12) United States Patent
Almouli

(10) Patent No.: US 8,277,226 B2
(45) **Date of Patent: *Oct. 2, 2012**

(54) ELECTRIC CONNECTOR WITH A LINEARLY AND CIRCULARLY DISPLACEABLE PLUG

(76) Inventor: Alon Almouli, Tel-Aviv (IL)

( * ) Notice: Subject to any disclaimer, the term of this patent is extended or adjusted under 35 U.S.C. 154(b) by 0 days.

This patent is subject to a terminal disclaimer.

(21) Appl. No.: 13/399,234

(22) Filed: Feb. 17, 2012

(65) Prior Publication Data

US 2012/0156937 A1 Jun. 21, 2012

Related U.S. Application Data

(63) Continuation of application No. 13/181,032, filed on Jul. 12, 2011, now Pat. No. 8,142,199.

(51) Int. Cl.
*H01R 39/00* (2006.01)

(52) U.S. Cl. ..... 439/10; 439/22; 439/640

(58) Field of Classification Search ..... 439/10, 439/22, 640, 21, 13, 14
See application file for complete search history.

(56) References Cited

U.S. PATENT DOCUMENTS

| | | | |
|---|---|---|---|
| 5,429,518 | A | 7/1995 | Chen |
| 5,957,701 | A | 9/1999 | McMillin |
| 6,089,921 | A | 7/2000 | Chou |
| 6,302,743 | B1 | 10/2001 | Chiu et al. |
| 7,500,854 | B2 | 3/2009 | Gottstein |
| 2006/0134933 | A1 | 6/2006 | Huang |

FOREIGN PATENT DOCUMENTS

| | | |
|---|---|---|
| CN | 2481021 | 3/2002 |
| EP | 1271717 | 1/2003 |
| JP | 11121123 | 4/1999 |
| KR | 20070030255 | 3/2007 |
| WO | 2009100122 | 8/2009 |
| WO | 2010014268 | 2/2010 |

OTHER PUBLICATIONS

Combined Search and Examination Report issued on Mar. 7, 2011 by the UKIPO for UK Patent Application No. GB1017782.2; 7 pages.
Combined Search and Examination Report issued on May 4, 2011 by the UKIPO for UK Patent Application No. GB1100110.4: 8 pages.

*Primary Examiner* — Edwin A. Leon
*Assistant Examiner* — Harshad Patel
(74) *Attorney, Agent, or Firm* — Cantor Colburn LLP

(57) ABSTRACT

An electric connector connecting one plug with several sockets in a housing, arranged to allow rotating the plug relative to the housing, as well as linearly moving the plug along the housing, while keeping the connector functional. The plug pins are movably connected to round flat tracks, which are movably connected to linear tracks that are connected via straps to the corresponding sockets' slots.

7 Claims, 21 Drawing Sheets

ELECTRIC CONNECTOR WITH A LINEARLY AND CIRCULARLY DISPLACEABLE PLUG

CROSS REFERENCE TO RELATED APPLICATIONS

This application is a Continuation of U.S. patent application Ser. No. 13/181,032 filed on Jul. 12, 2011, now allowed, which claims priority to United Kingdom Application No. GB1017782.2 filed on Oct. 21, 2010 and United Kingdom Application No. GB1100110.4, filed on Jan. 6, 2011, all which are incorporated herein by reference in their entirety.

TECHNICAL FIELD

The present invention relates to the field of electricity, and more particularly, to an electric connector.

DISCUSSION OF RELATED ART

Electric connectors are commonly used as an interface between one plug (connectable to a wall socket) and several sockets, such as to allow connecting several appliances to the electricity net through a single socket.

Common electric connectors are rigid and require certain free space around the wall socket in order to connect the electric connector properly.

BRIEF SUMMARY

Provided herein is a method of changing the position of at least one socket in respect to a plug of an electric connector, the method comprising the steps of: providing an electric connector, the connector comprising: a plug having at least two pins and a housing having at least one sockets at a housing basis, the socket having at least two slots therein, wherein the plug is coaxially rotatable in respect to the housing, whereby, using a contact connection, each pin is connected to a round flat track, wherein the contact connections are circularly movable along the round flat track upon rotation of the plug within the housing; wherein each round flat track is connected to a corresponding wired contact, whereby each wired contact is slidably enclosed within a corresponding linear track that is connected via a corresponding strap to a corresponding slot; and the housing further comprises a guiding plate positioned between the round flat tracks and the linear tracks and comprising a corresponding slit for each wired contact, wherein the plug is slidably movable along the guiding plate with the wired contacts moving through the slits and continuously contacting the linear tracks; and sliding the plug along the slits, rotating the plug in respect to the housing or a combination comprising at least one of the foregoing, thereby changing the position of the socket in respect to the plug.

BRIEF DESCRIPTION OF THE DRAWINGS

The present invention will be more readily understood from the detailed description of embodiments thereof made in conjunction with the accompanying drawings of which.

DETAILED DESCRIPTION

Figure 1B:
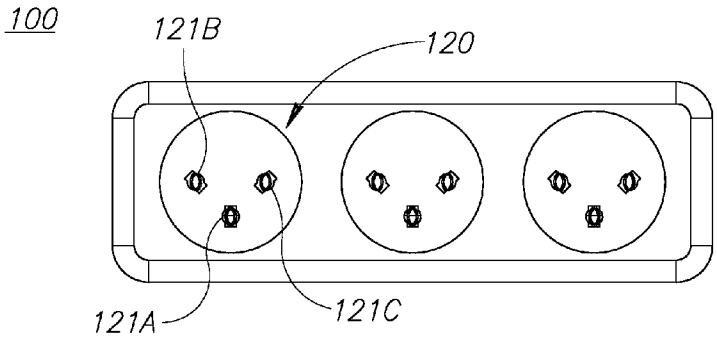
FIGS. 1A to 1C are schematic perspective illustrations of an electric connector with a linearly and circularly displaceable plug, according to some embodiments of the invention.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

FIGS. 1-6 are schematic illustrations of an electric connector 100 with a linearly and circularly displaceable plug 110, according to some embodiments of the invention.

Electric connector 100 (FIGS. 1A to 1C) comprises plug 110 having at least two pins 115A (e.g. earth), 115B (e.g. neutral), 115C (e.g. live), and a housing 130 having at least one socket 120 at a housing basis 130B. Housing 130 may comprise two or three sockets 120 or more. Each socket 120 has at least two slots 121A (e.g. earth), 121B (e.g. neutral), 121C (e.g. live). Each slot per socket 120 corresponds to one of pins 115 and is connected thereto via: contacts 127 (127A, 127B, 127C) connected to contact straps 151 (151A, 151B, 151C) which are connected to linear tracks 155 (155A, 155B, 155C, FIGS. 3-5). Each linear track 155 may comprise two parallel straps 152, 153 held together by a fastener 124 (155A: 152A, 153A, 124A, 155B: 152B, 153B, 124B, 155C: 152C, 153C, 124C) that ensures continuous contact between corresponding wired contacts 123 and linear tracks 155. For example, straps 153 may be connected to contact straps 151.

Each pin 115 (FIGS. 2, 3, 5) is connected to a round flat conductive track 140 that is parallel to a housing basis 130B and may be supported within housing 130 such that each track 140 is positioned at a specified height in respect to housing basis 130B within housing 130. Tracks 140 may be annular. Track 140C having the smallest diameter may be circular. The connection of pins 115 to tracks 140 is carried out via contact connections 145 (145A, 145B, 145C, FIG. 5), which rotate with plug 110 while continuously maintaining contact to tracks 140. Contact connections 145 may be mounted in housing 130 such as to apply a pressure on the respective tracks 140, to yield continuous electrical contact therewith during rotation of plug 110. For example, the ends of contact connections 145 may be bent or preloaded to push against tracks 140.

Tracks 140 are connected to wired contacts 123 (123A, 123B, 123C) which are held between straps 152, 153 as explained above, and connected via straps 153 and straps 151 to contacts 127. In the illustrated example, A denotes earth, B neutral, and C live elements.

Wired contacts 123 are movable along linear tracks 155 to allow a user determined position of the connector body in respect to plug 110. In association with the possibility to rotate the connector body around plug 110, the disclosed connector allows unprecedented flexibility in arranging the connector body at a required position, overcoming placing limitations inflicted by wall sockets.

Figure 1C:
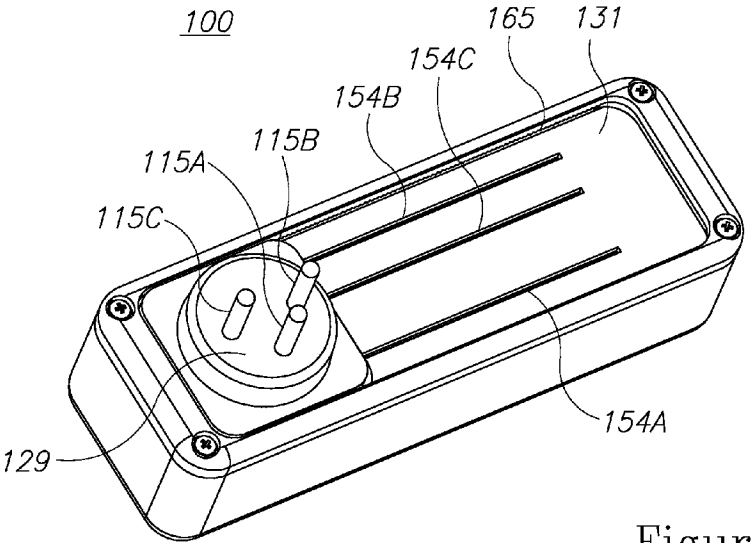
Figure 1A:
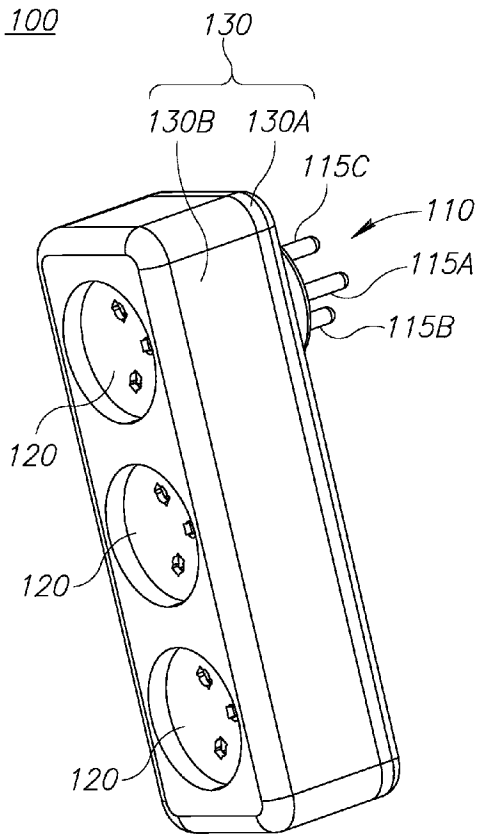
Figure 2:
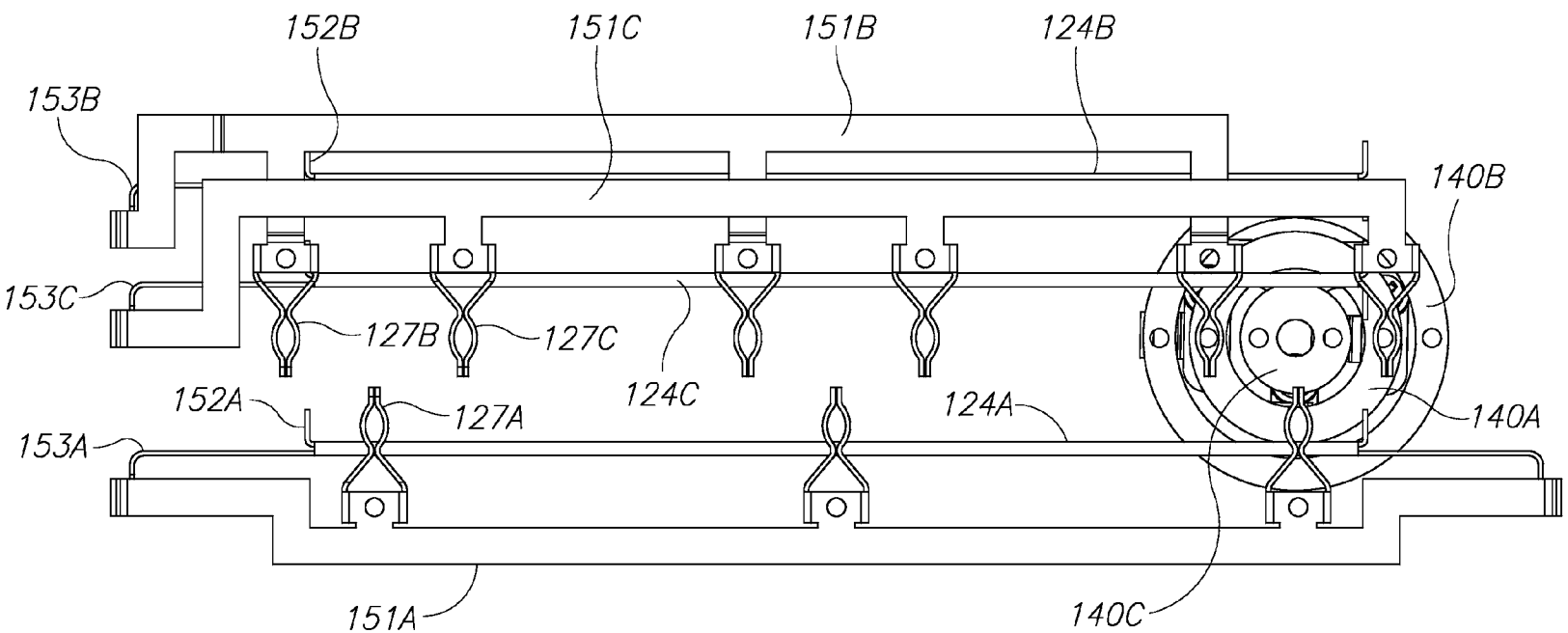
FIGS. 2 and 3 are schematic upper and perspective views (respectively) of the inner structures in the electric connector, according to some embodiments of the invention.
Figure 3:
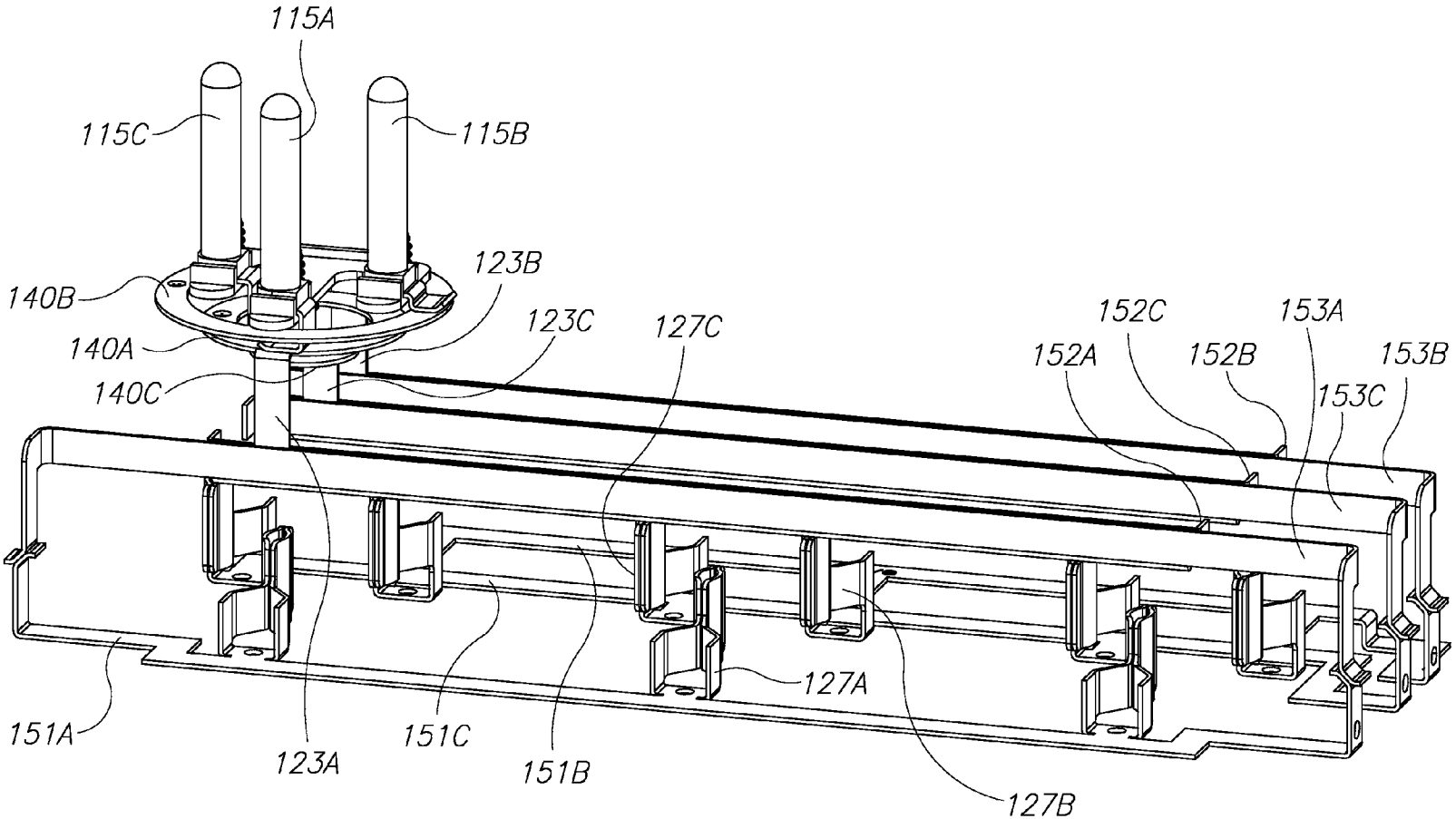
Figures 4A, 4B, 4C:
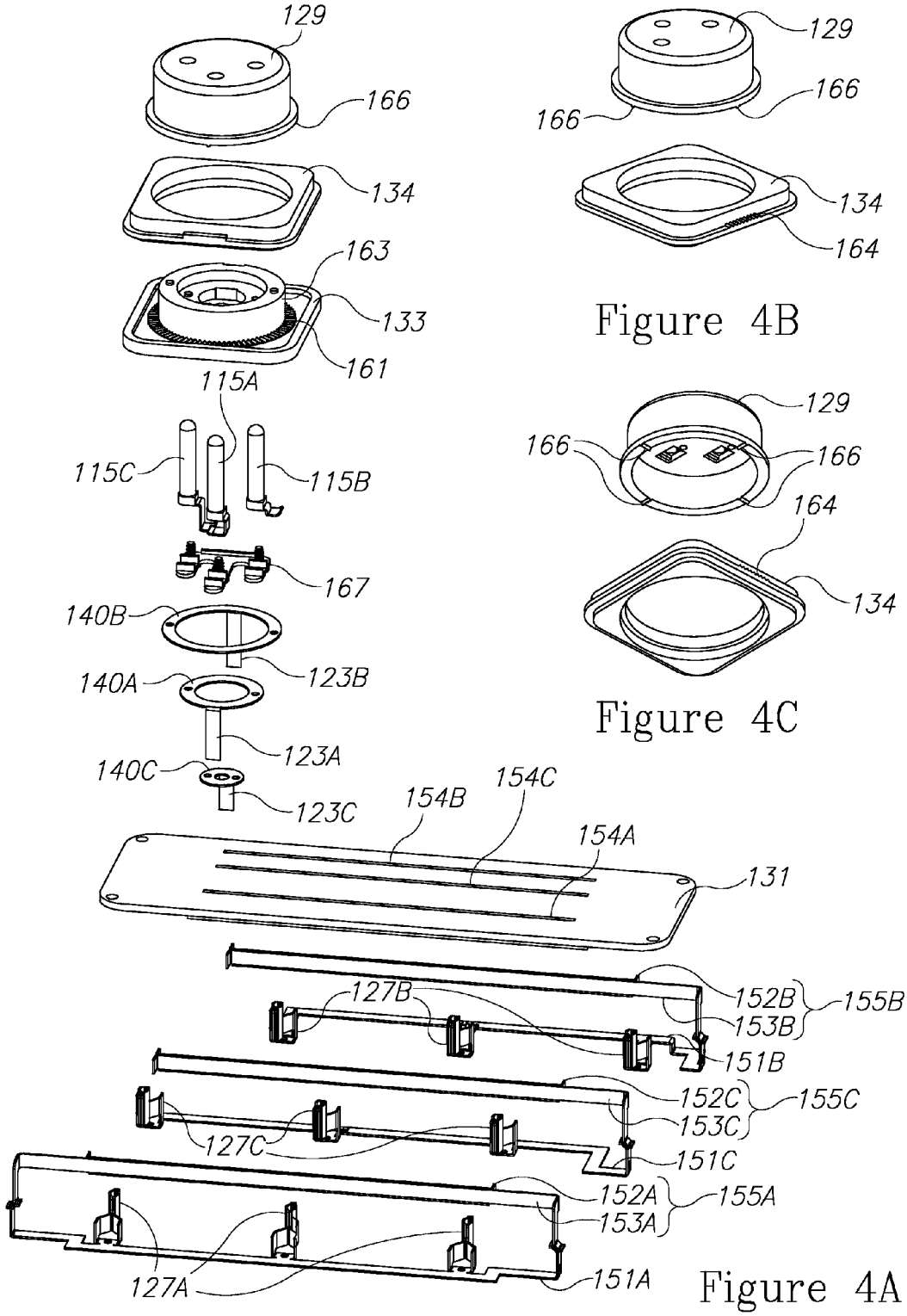
FIGS. 4A to 4C are a schematic exploded view of the electric connector, according to some embodiments of the invention.
Figure 5:
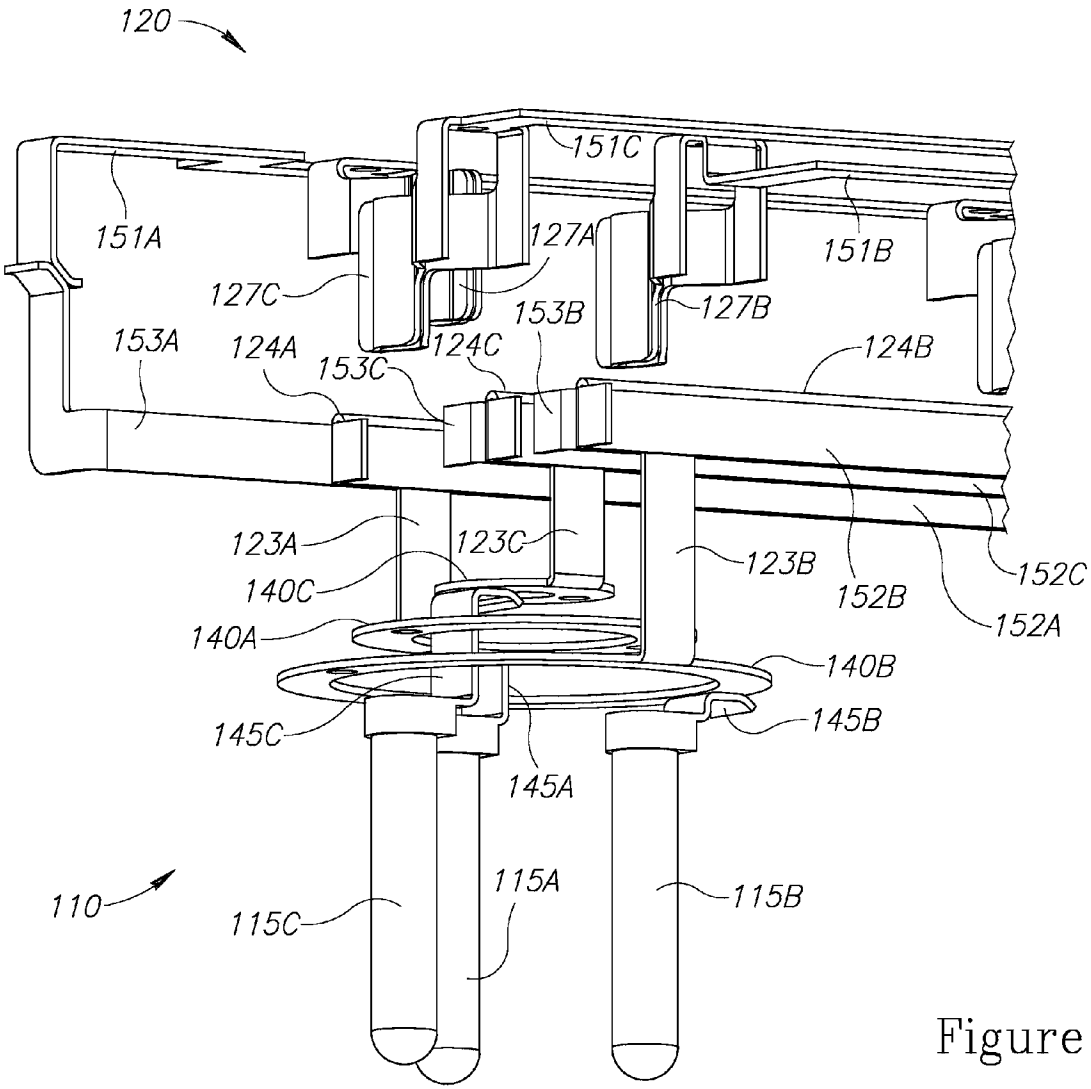
FIGS. 5 and 6 are schematic detailed views of the motion mechanisms of the plug, according to some embodiments of the invention.
Figure 6:
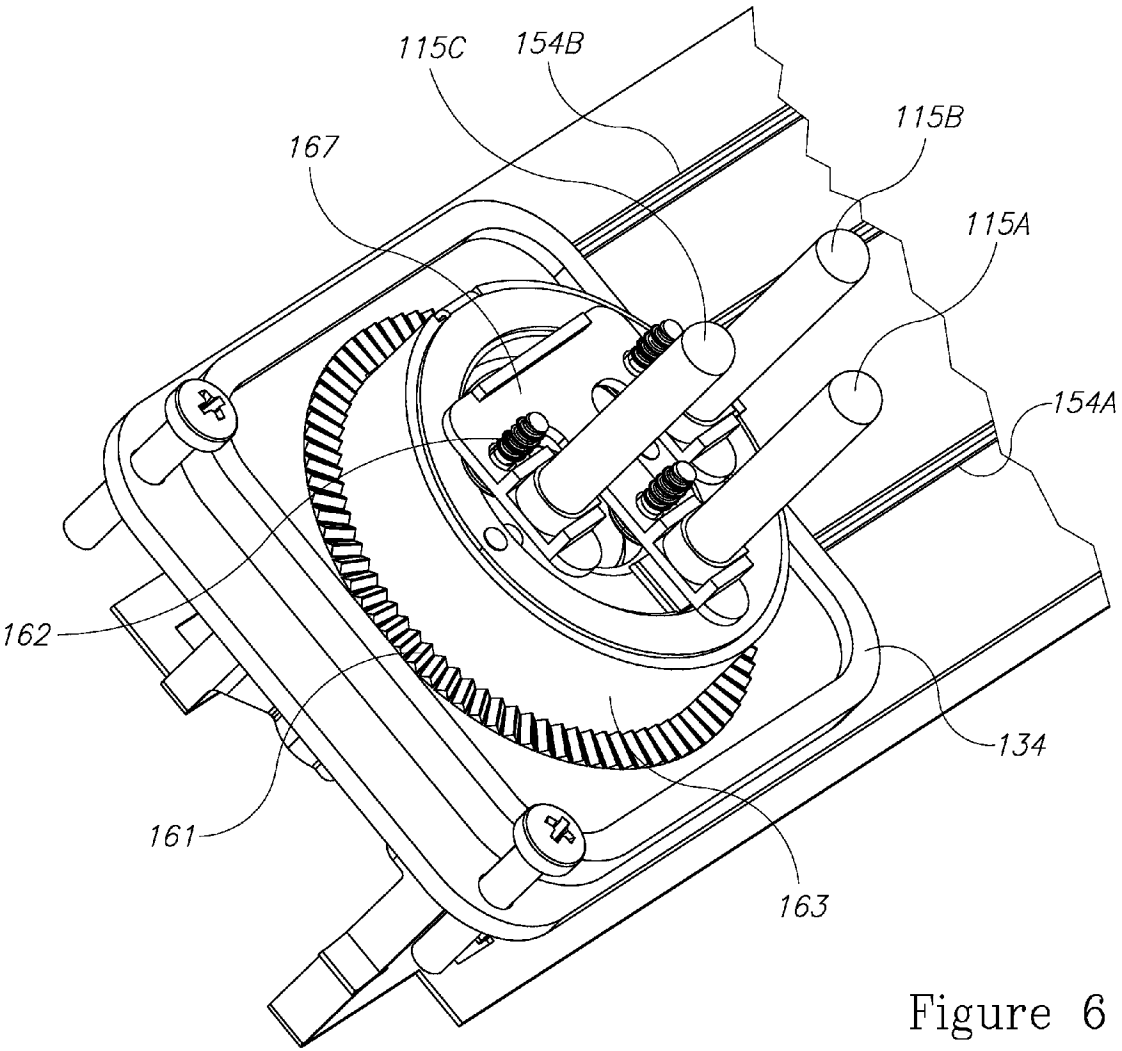

Wired contacts 123 go through corresponding slits 154 (123A through 154A, 123B through 154B and 123C through 154C) in a guiding plate 131 (FIGS. 1C, 4). Plug 110 is arranged to move along guiding plate 131 with wired contacts 123 moving through slits 154 and continuously contacting tracks 152, 153. Guiding plate 131 may further comprise indentations 165 for controlling the horizontal linear movement of plug 110 along slits 154, by accommodating a protrusion 164 from plug 110 (e.g. from bases 133 or 134, FIGS. 4B, 4C).

In addition, a plug base 133 may comprise annularly arranged indentations 161 for controlling the rotary movement of plug 110, by accommodating a protrusion 166 from plug cap 129 (FIG. 4A). Plug cap 129 may comprise a basis 167 affixed to plug basis 163 by screws 162.

Conductive tracks 140 (FIGS. 3, 5) are concentric and may have an increasing diameter from the lowest (140C) to the highest (140B) track 140 in respect to housing basis 130B. In the design illustrated in FIG. 5, track 140B with the largest diameter is closest to plug 110, track 140A has an intermediate diameter 142A, and track 140C, having the smallest diameter is the farthest from plug 110.

The association between tracks 140 and the function of each track 140 and pin 115 may be selected at will. The illustrated association of A-earth, B-neutral, C-live is arbitrary and may be replaced by any configuration, with the appropriate structural changes. Advantageously, the widest track 140B may be neutral, intermediate track 140A may be earth, and smallest track 140C may be live.

Conductive tracks 140, tracks 152, 153, wired contacts 123 and straps 151 may be made of copper, and may be flat, or have a form or a profile that are arranged to ensure continuous contact.

Electric connector 100 allows rotating housing 130 in respect to plug 110 at any user specified angle, as well as displacing housing 130 in respect to plug 110 at any used specified distance, while maintaining the connector functionality.

Embodiments of electric connector 100 may be designed to comply with any standard, as the exact ordering of pins 115 and slots 121 does not interfere with the transmission of current between tracks 140 and connections 145.

Electric connector 100 is designed to provide maximal usage safety. For example, tracks 140, 152, 153 as well as contact connections 145 and straps 151 may supported and fixated by the housing protrusions or plug support 129, 133, 134 and housing basis 130B. The continuous contact between tracks 140 and contact connections 145 is ensured by stabilizing contact connections 145 within tracks 140. The continuous contact between wired contacts 123 and linear tracks 155 is ensured by stabilizing wired contacts 123 within linear tracks 155.

To summarize, electric connector 100 connects one plug 110 with several sockets 120 in housing 130, and is arranged to allow rotating as well as displacing plug 110 relative to housing 130, while keeping connector 100 functional. Plug pins 115 are connected to conducting tracks 140 by contact connections 145 that are allowed to rotate with plug 110 within housing 130. Conducting tracks 140 are positioned within housing 130 coaxially at different heights and have different diameters. Wired contacts 123 movably contact linear tracks 155 which are connected to contact connections 127 behind slots of sockets 120 via straps 151. Wired contacts 123 are held tightly within linear tracks 155 to maintain electric contact, yet enable movement of wired tracks 123 within linear tracks 155.

Figure 7:
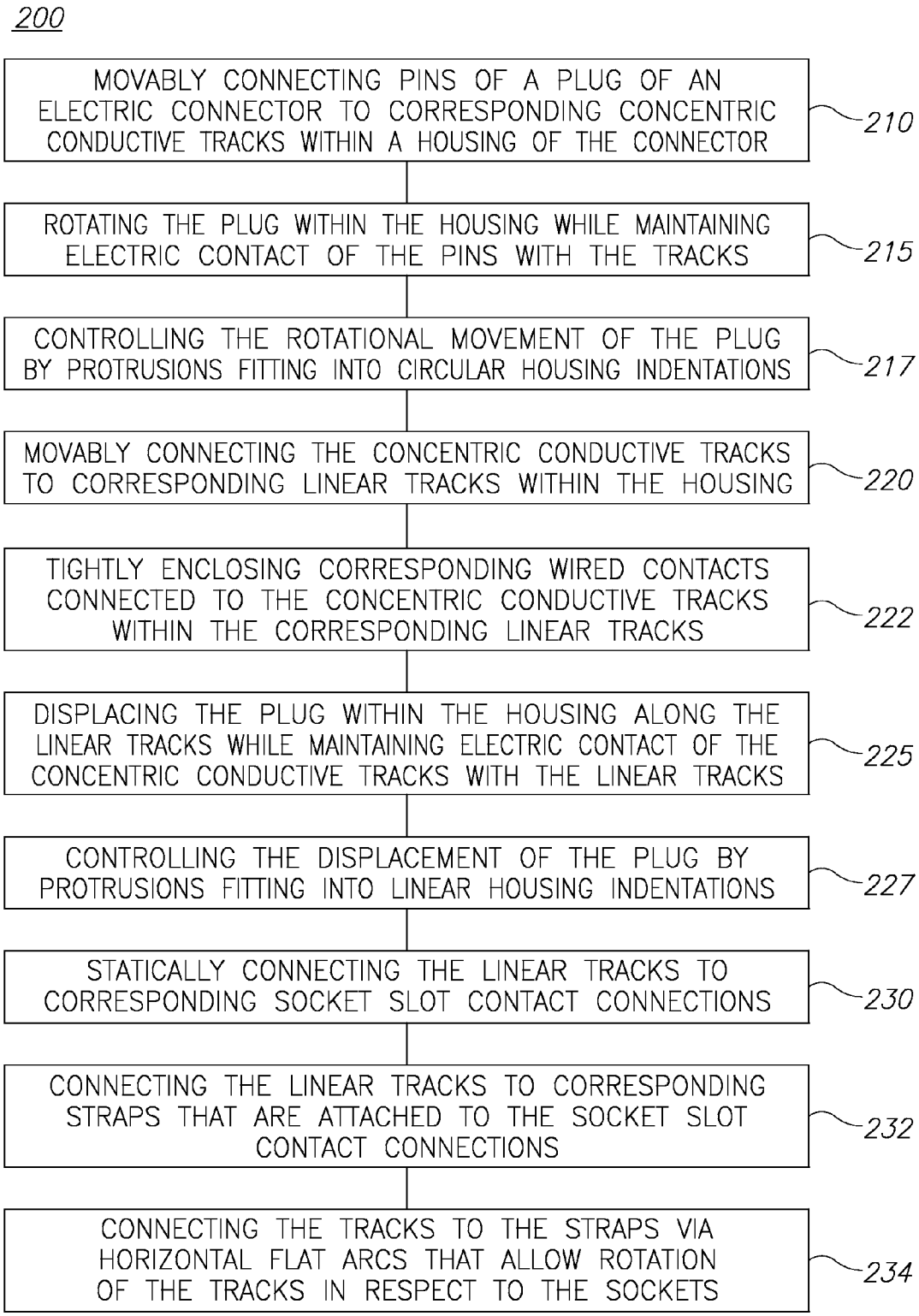
FIG. 7 is a high level schematic flowchart of a method, according to some embodiments of the invention.

FIG. 7 is a high level schematic flowchart of a method 200, according to some embodiments of the invention. Method 200 enables to both rotate and displace plug 110 in respect to a connector body, thus allowing unprecedented flexibility in arranging the connector body at a required position, overcoming placing limitations inflicted by wall sockets.

Method 200 comprises the following stages: movably connecting pins of a plug of an electric connector to corresponding concentric conductive tracks within a housing of the connector (stage 210), to enable rotating the plug within the housing while maintaining electric contact of the pins with the tracks (stage 215), possibly controlling the rotational movement of the plug by protrusion(s) fitting into circular housing indentations (stage 217).

Method 200 further comprises the following stages: movably connecting the concentric conductive tracks to corresponding linear tracks within the housing (stage 220), e.g. by tightly enclosing corresponding wired contacts connected to the concentric conductive tracks within the corresponding linear tracks (stage 222), to enable displacing the plug within the housing along the linear tracks while maintaining electric contact of the concentric conductive tracks with the linear tracks (stage 225), possibly controlling the displacement of the plug by protrusion(s) fitting into linear housing indentations (stage 227).

Method 200 further comprises statically connecting the linear tracks to corresponding socket slot contact connections (stage 230), e.g. by connecting the linear tracks to corresponding straps that are attached to the socket slot contact connections (stage 232). Method 200 may further comprise connecting the tracks to the straps via horizontal flat arcs that allow rotation of the tracks in respect to the sockets (stage 234, see below).

FIGS. 8-12 are schematic illustrations of an electric connector 100 with a linearly and circularly displaceable plug 110, according to some embodiments of the invention.

Figure 9:
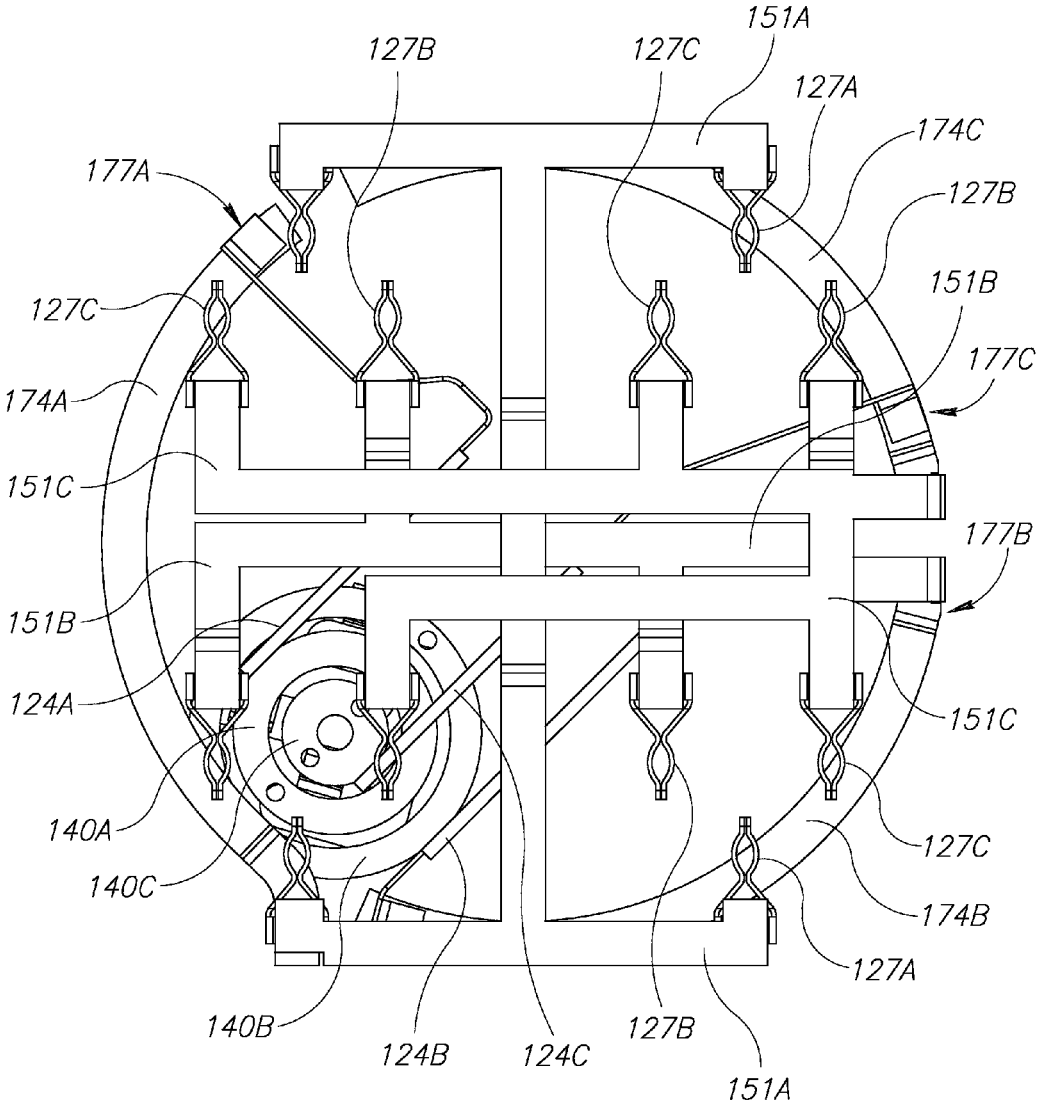
FIGS. 9-11 are schematic upper and two perspective views (respectively) of the inner structures in the electric connector, according to some embodiments of the invention.
Figure 10:
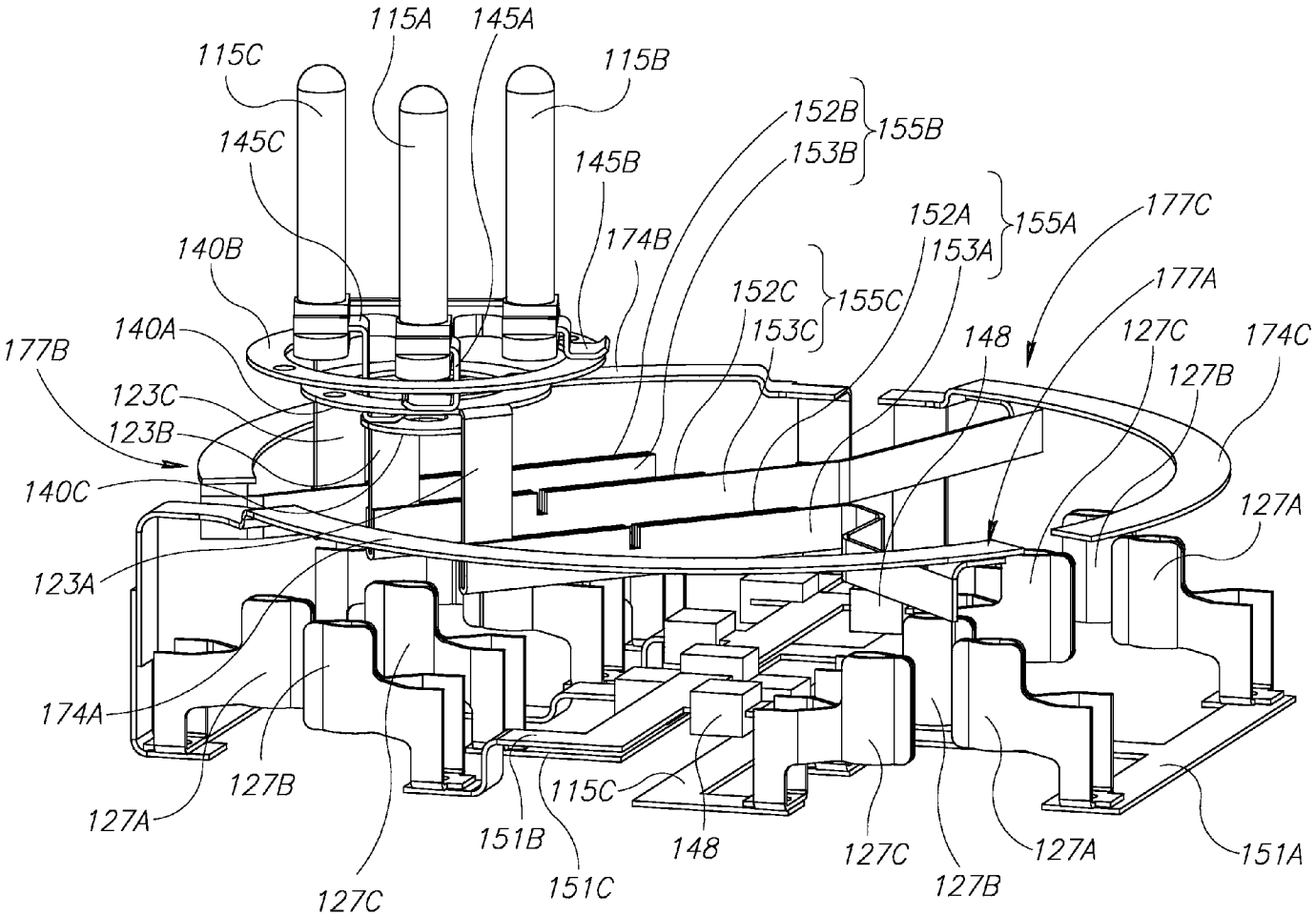
Figure 11:
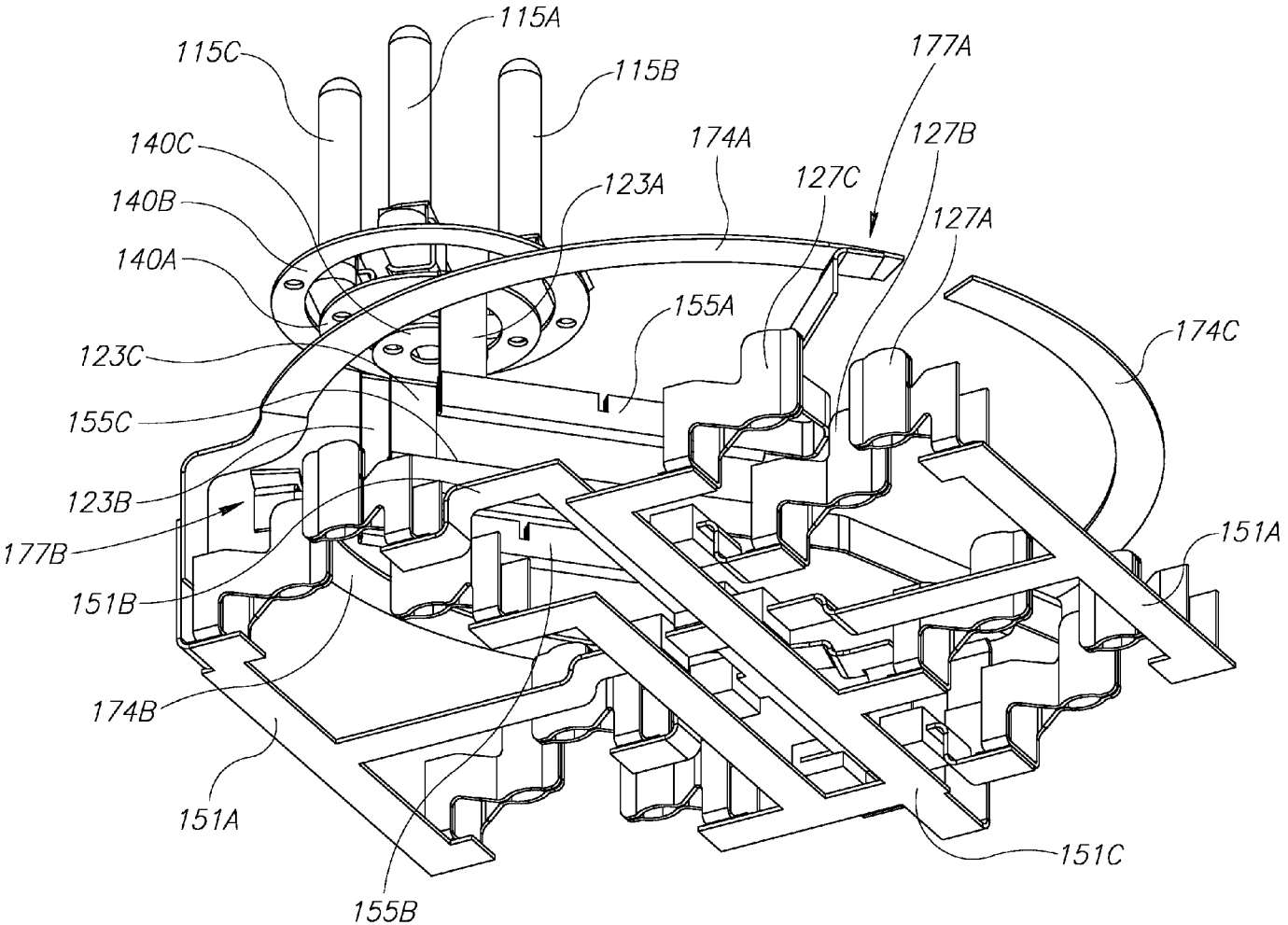

Electric connector 100 (FIGS. 8A to 8C) comprises plug 110 having at least two pins 115A (e.g. earth), 115B (e.g. neutral), 115C (e.g. live), and a housing 130 having at least one socket 120 at a housing basis 130B and plug 110 at housing cover 130B. Housing 130 may comprise four 120 or more, arranged in a two dimensional array. Each socket 120 has at least two slots 121A (e.g. earth), 121B (e.g. neutral), 121C (e.g. live). Each slot per socket 120 corresponds to one of pins 115 and is connected thereto via: contacts 127 (127A, 127B, 127C) connected to contact straps 151 (151A, 151B, 151C) which are connected to linear tracks 155 (155A, 155B, 155C) via a horizontal flat arc 174 (174A, 174B, 174C) that is parallel to corresponding strap 151 (FIGS. 9-11).

Flat arcs 174 may be arranged peripherally within housing 130 to optimize access to linear tracks 155 and straps 151. Straps 151 may have distinct two dimensional shapes arranged to reach each of corresponding slots 121 (FIGS. 9 and 11). Straps 151 may be separated by spacers 148 arranged to support, separate and isolate straps 151 from each other.

Each linear track 155 may comprise two parallel straps 152, 153 held together by a fastener 124 (155A: 152A, 153A, 124A, 155B: 152B, 153B, 124B, 155C: 152C, 153C, 124C) that ensures continuous contact between corresponding wired contacts 123 and linear tracks 155. For example, straps 153 may be connected to contact straps 151.

Each pin 115 (FIG. 10) is connected to a round flat conductive track 140 that is parallel to a housing basis 130B and may be supported within housing 130 such that each track 140 is positioned at a specified height in respect to housing basis 130B within housing 130. Tracks 140 may be annular. Track 140C having the smallest diameter may be circular. The connection of pins 115 to tracks 140 is carried out via contact connections 145 (145A, 145B, 145C), which rotate with plug 110 while continuously maintaining contact to tracks 140. Contact connections 145 may be mounted in housing 130 such as to apply a pressure on the respective tracks 140, to yield continuous electrical contact therewith during rotation of plug 110. For example, the ends of contact connections 145 may be bent or preloaded to push against tracks 140.

Tracks 140 are connected to wired contacts 123 (123A, 123B, 123C) which are held between straps 152, 153 as explained above, and connected via straps 153 and straps 151 to contacts 127. In the illustrated example, A denotes earth, B neutral and C live elements.

Wired contacts 123 are movable along linear tracks 155 to allow a user determined position of the connector body in respect to plug 110. Furthermore, contacts 177 of tracks 155 to horizontal flat arcs 174 are movable along arcs 174 upon rotation of round guiding plate 131 (FIG. 8B, 177A connecting track 155A to flat arc 174A, 177B connecting track 155B to flat arc 174B, 177C connecting track 155C to flat arc 174C) with which tracks 155 are associated. Rotating guiding plate 131 is possibly in almost 120° in the illustrated embodiment of three arcs 174. Overall, connector 100 exhibits three motion lines—360° of plug 110 by the movable contacts 123 in respect to tracks 140, linear motion of contacts 123 in respect to tracks 155 and 120° of guiding plate 131 by the circular motion of contacts 177 along flat arcs 174. The disclosed connector allows unprecedented flexibility in arranging the connector body at a required position, overcoming placing limitations inflicted by wall sockets.

Figure 8A:
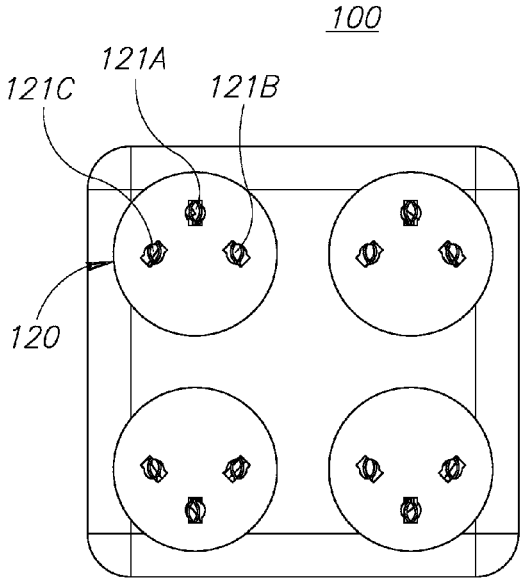
FIGS. 8A to 8C are schematic perspective illustrations of an electric connector with a linearly and circularly displaceable plug, according to some embodiments of the invention.
Figure 8B:
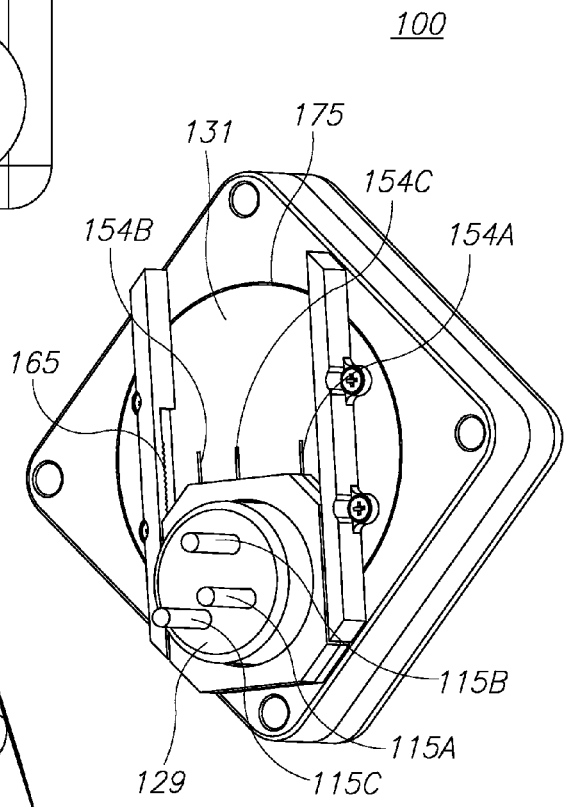
Figure 8C:
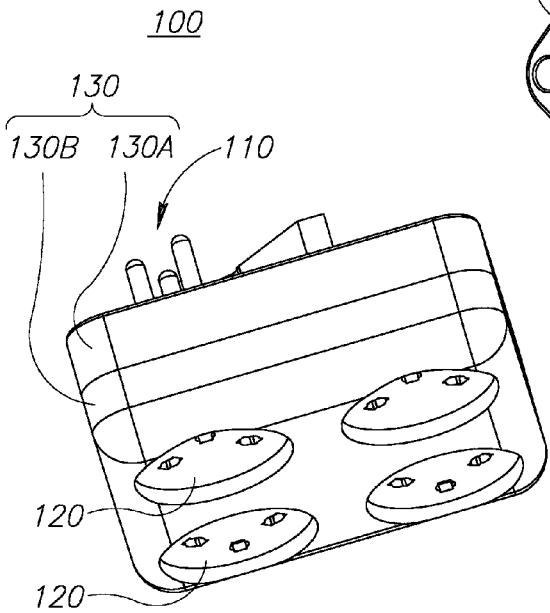

Wired contacts 123 go through corresponding slits 154 (123A through 154A, 123B through 154B and 123C through 154C) in guiding plate 131 (FIG. 8B). Plug 110 is arranged to move along guiding plate 131 with wired contacts 123 moving through slits 154 and continuously contacting tracks 152, 153. Guiding plate 131 may further comprise indentations 165 for controlling the horizontal linear movement of plug 110 along slits 154, by accommodating a protrusion 164 from plug 110 (e.g. from bases 133 or 134, FIG. 12).

Figure 12:
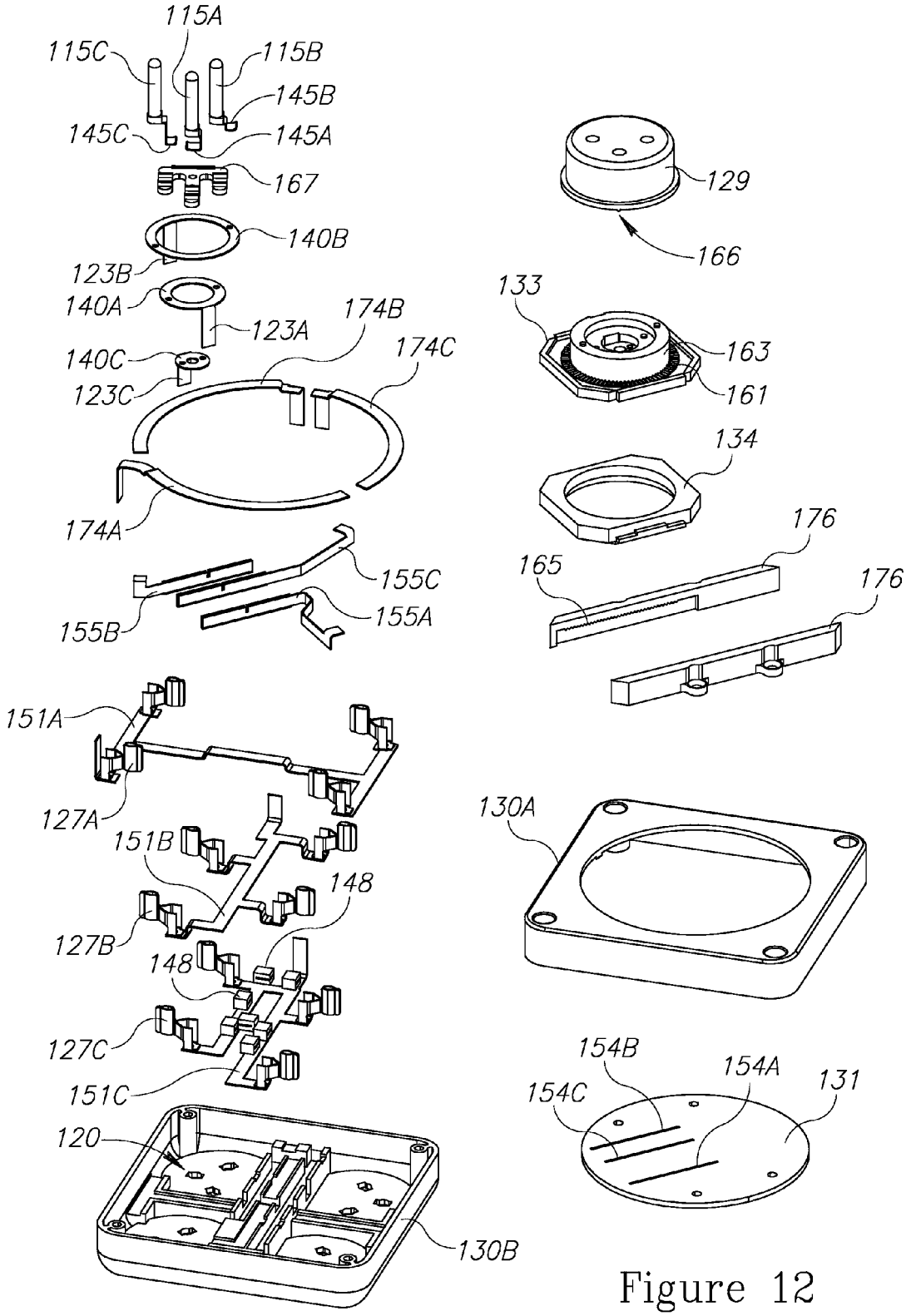
FIG. 12 is a schematic exploded view of the electric connector, according to some embodiments of the invention.

In addition, plug base 133 may comprise annularly arranged indentations 161 for controlling the rotary movement of plug 110, by accommodating a protrusion 166 from plug cap 129 (FIG. 12). Plug cap 129 may comprise guiding rail 176 that support the linear motion of plug 110 and may be mounted on guiding plate 131 to rotate therewith.

Conductive tracks 140 (FIGS. 9-11) are concentric and may have an increasing diameter from the lowest (140C) to the highest (140B) track 140 in respect to housing basis 130B. In the design illustrated in FIG. 10, track 140B with the largest diameter is closest to plug 110, track 140A has an intermediate diameter 142A, and track 140C, having the smallest diameter is the farthest from plug 110.

The association between tracks 140 and the function of each track 140 and pin 115 may be selected at will. The illustrated association of A-earth, B-neutral, C-live is arbitrary and may be replaced by any configuration, with the appropriate structural changes. Advantageously, the widest track 140B may be neutral, intermediate track 140A may be earth, and smallest track 140C may be live.

Conductive tracks 140, tracks 152, 153, wired contacts 123, horizontal flat arcs 174 and straps 151 may be made of copper, and may be flat, or have a form or a profile that are arranged to ensure continuous contact.

Electric connector 100 allows rotating housing 130 in respect to plug 110 at any user specified angle, as well as displacing housing 130 in respect to plug 110 at any used specified distance, while maintaining the connector functionality.

Embodiments of electric connector 100 may be designed to comply with any standard, as the exact ordering of pins 115 and slots 121 does not interfere with the transmission of current between tracks 140 and connections 145.

Electric connector 100 is designed to provide maximal usage safety. For example, tracks 140, 152, 153 as well as contact connections 145, horizontal flat arcs 174 and straps 151 may supported and fixated by the housing protrusions or plug support 129, 133, 134, 148 and housing basis 130B. The continuous contact between tracks 140 and contact connections 145 is ensured by stabilizing contact connections 145 within tracks 140. The continuous contact between wired contacts 123 and linear tracks 155 is ensured by stabilizing wired contacts 123 within linear tracks 155. The continuous contact between linear tracks 155 and horizontal flat arcs 174 is ensured by stabilizing wired contacts 177, and the continuous contact between horizontal flat arcs 174 and straps 151 is ensured by stabilizing straps 151 by e.g. spacers 148.

To summarize, electric connector 100 connects one plug 110 with several sockets 120 in housing 130, and is arranged to allow rotating as well as displacing plug 110 relative to housing 130, while keeping connector 100 functional. Plug pins 115 are connected to conducting tracks 140 by contact connections 145 that are allowed to rotate with plug 110 within housing 130. Conducting tracks 140 are positioned within housing 130 coaxially at different heights and have different diameters. Wired contacts 123 movably contact linear tracks 155 which are connected to contact connections 127 behind slots of sockets 120. Linear tracks 155 are movably connected via horizontal flat arcs 174 to straps 151 to allow rotation of plug 110 together with linear tracks 155. Wired contacts 123 are held tightly within linear tracks 155 to maintain electric contact, yet enable movement of wired tracks 123 within linear tracks 155, as well as are linear tracks 155 in their contact with horizontal flat arcs 174 (at connections 177).

Figure 13:
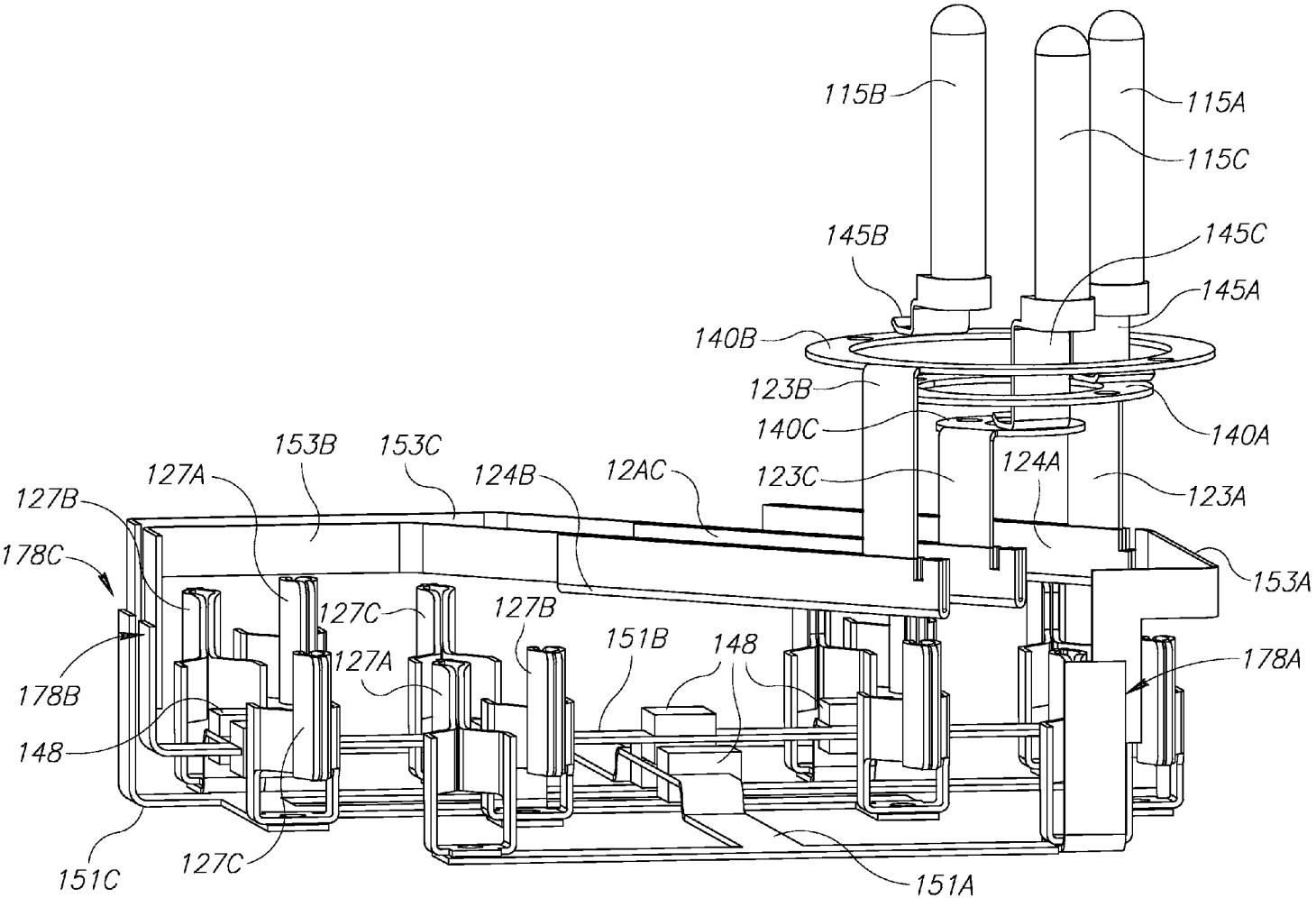
FIGS. 13-15 illustrate the electric connector, according to some embodiments of the invention.
Figure 14:
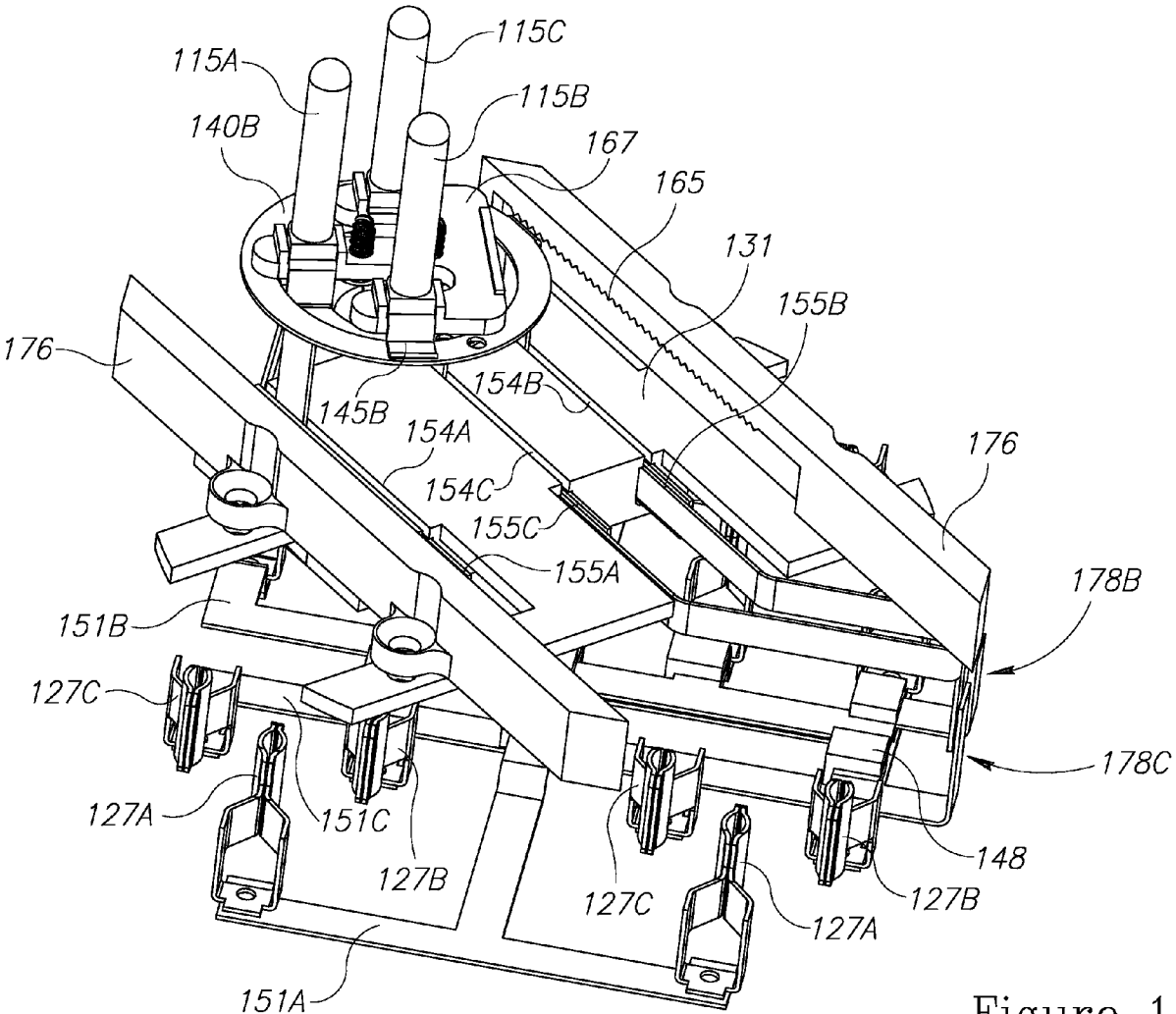
Figure 15:
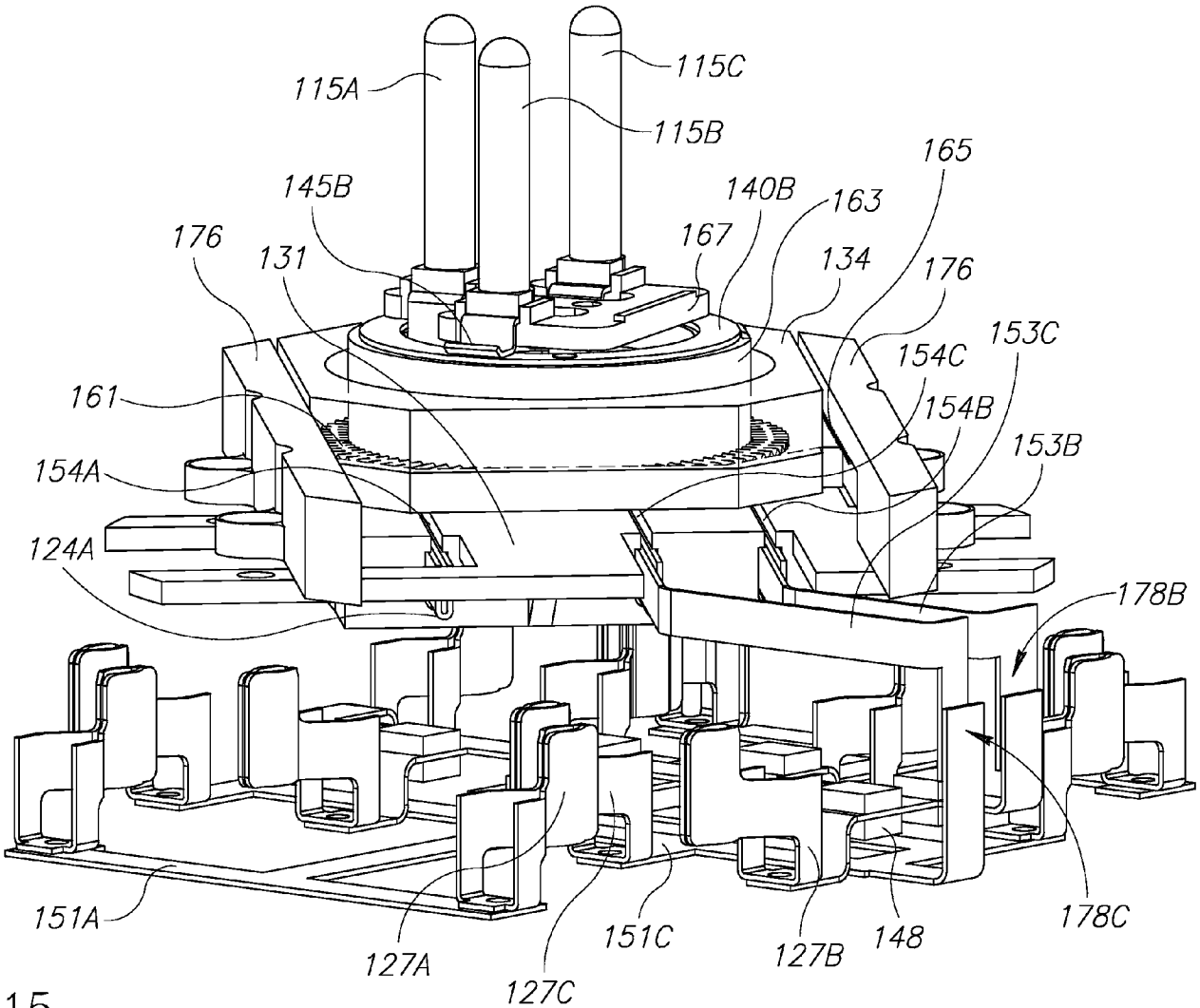
Figure 17:
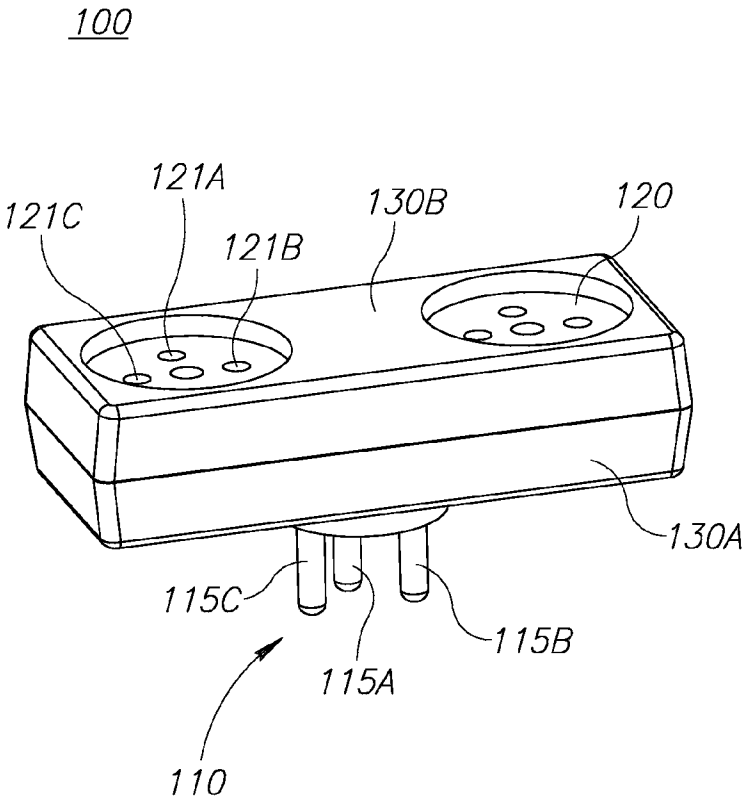
FIGS. 16 and 17 are schematic perspective illustrations of an electric connector, according to some embodiments of the invention.
Figure 16:
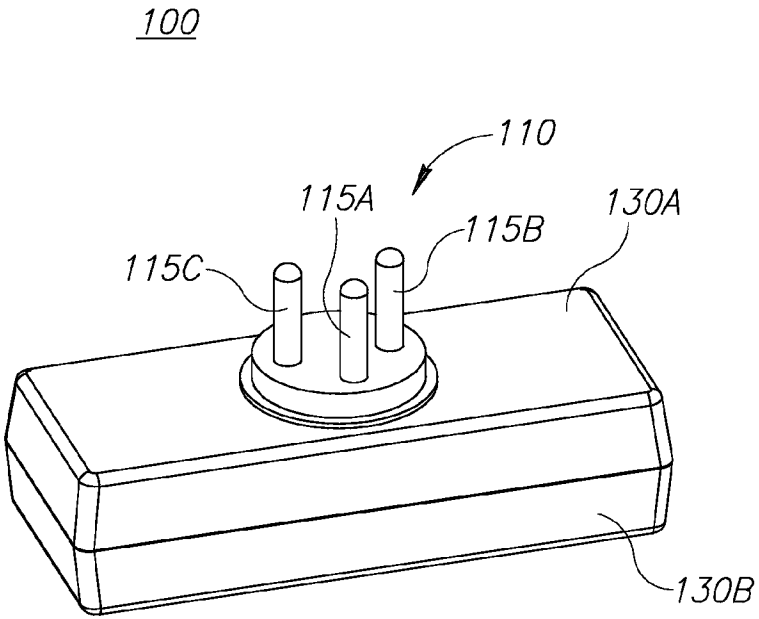

FIGS. 13-15 illustrate electric connector 100, according to some embodiments of the invention. In these illustrations, linear tracks 155 are connected via contacts 178 to corresponding straps 151 (178A, 178B and 178C connecting track 155A with strap 151A, track 155B with strap 151B and track 155C with strap 151C, respectively). Plug 110 is movable along guiding plate 131 with wired contacts 123 moving through slits 154 and continuously contacting the linear tracks 155. In these embodiments, guiding plate 131 is not allowed to rotate within housing 130, and only two movements of plug 110 are allowed—rotation of plug 110 (with contact connections 145 moving along round flat track 140) and a linear movement of plug 110 (with wired contacts 123 contacting tracks 155).

These movements are supported by two pairs of protrusions that are engaged in indentations—protrusions 164 in plug basis 134 that engage in indentations 165 and protrusions 166 in plug cap 129 that engage in indentation 161. FIG. 15 with cap 129 removed and transparent plug basis 134 illustrate an embodiment of these coupling mechanisms.

FIGS. 16-20 are schematic illustrations of electric connector 100, according to some embodiments of the invention.

Electric connector 100 (FIGS. 16, 17) comprises a plug 110 having at least two pins 115A (e.g. earth), 115C (e.g. live), 115B (e.g. neutral), and a housing 130 having at least one socket 120 at a housing basis 130B. Housing 130 may comprise one socket 120, two or three sockets 120 or more. Each socket 120 has at least two slots 121A (e.g. earth), 121C (e.g. live), 121B (e.g. neutral). Each slot 121 (121A, 121B, 121C) corresponds to one of pins 115 (121A to 115A, 121B to 115B and 115C to 121C) and connected to a wired contact 123 within housing 130.

Figure 18:
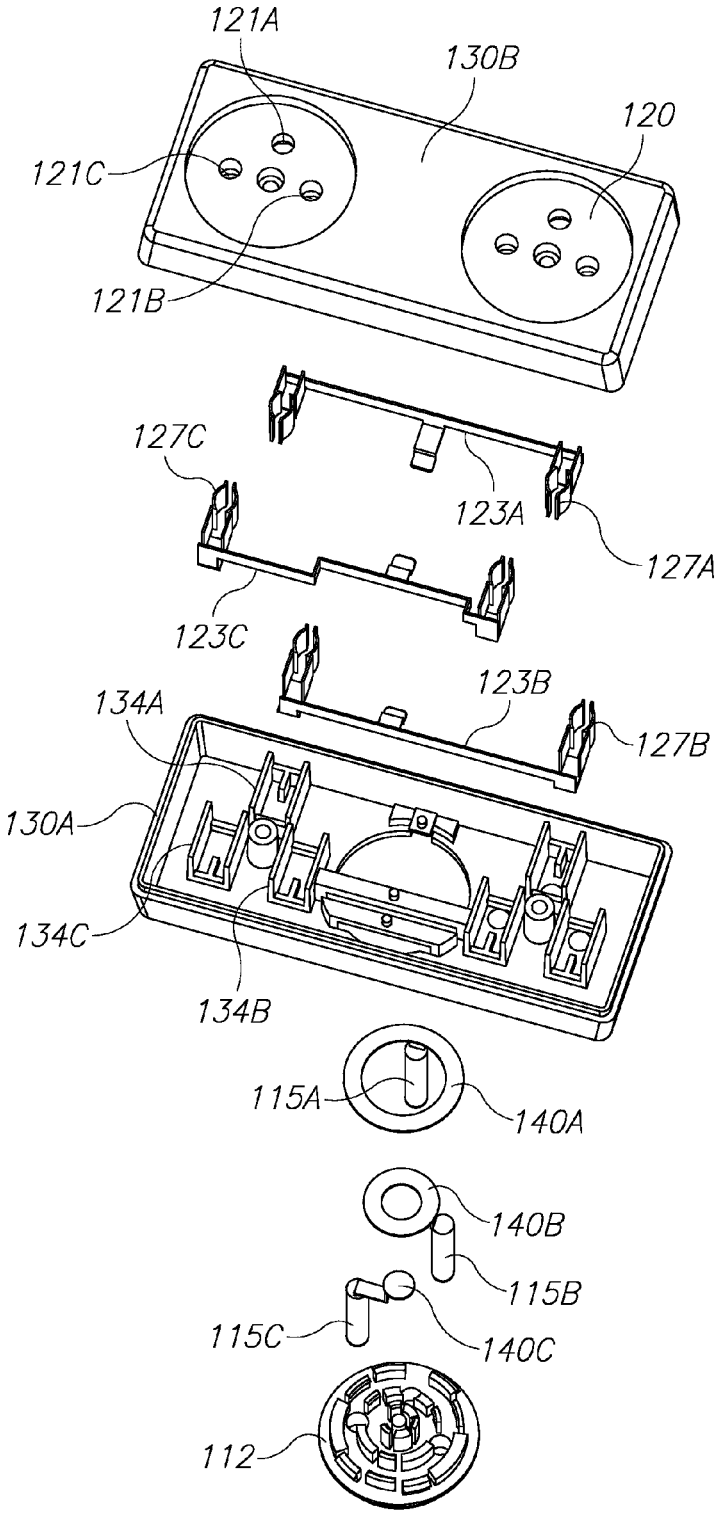
FIG. 18 is a schematic exploded view illustrating an electric connector, according to some embodiments of the invention.

Each pin 115 (FIGS. 18-20) is connected to a round flat conductive track 140 that is parallel to a housing basis 130B and supported within housing 130 by protrusions in a support 112 such that each track 140 (140A, 140B, 140C) is positioned at a specified height 141 (141A, 141B, 141C) in respect to housing basis 130B within housing 130. Support 112 may be integrated into a plug support, into housing 130, or in an independent part as illustrated in FIG. 18) such as to support tracks 140 during their rotation. Tracks 140 may be annular. Track 140C having the smallest diameter may be circular.

Connection to slots 121 (121A, 121B, 121C, FIG. 18) is achieved via contacts 127 (127A, 127B, 127C respectively), connected to wired contacts 123 (123A, 123B, 123C respectively), which are in turn connected via contact connections 145 (145A, 145B, 145C respectively, FIGS. 18 and 20) to conductive tracks 140. The protrusions in support 112 are arranged to stabilize plug 110 and conductive tracks 140 within housing 130 and during their rotation. Pins 115 may be accommodated in openings between the protrusions in support 112, when designed as a plug support.

Conductive tracks 140 (FIGS. 19, 20) are concentric and have an increasing diameter 142 (142A, 142B, 142C) from the lowest (140A) to the highest (140C) track 140 in respect to housing basis 130B. In the design illustrated in FIG. 16, track 140A with the largest diameter 142A is closest to plug 110, track 140B has an intermediate diameter 142B, and track 140C, having the smallest diameter 142C is the farthest from plug 110.

The association between tracks 140 and the function of each track 140 and pin 115 may be selected at will. The illustrated association of A-earth, C-live, B-neutral is arbitrary and may be replaced by any configuration, with the appropriate structural changes. Advantageously, the widest track 140A may be ground, intermediate track 140B may be neutral, and smallest upper track 140C may be live, thereby having the ground and neutral adjacent, and the live with the smallest movements.

Plug 110 with pins 115 and conductive tracks 140 is coaxially rotatable in respect to housing 130. Support 112 (e.g. as a plug support 129 of plug 110) is arranged to support conductive tracks 140 while they rotate within a mechanical socket 128 of housing 130. Mechanical socket 128 may comprise an indentation in plug support 129 that is supported against housing 130.

Figure 20:
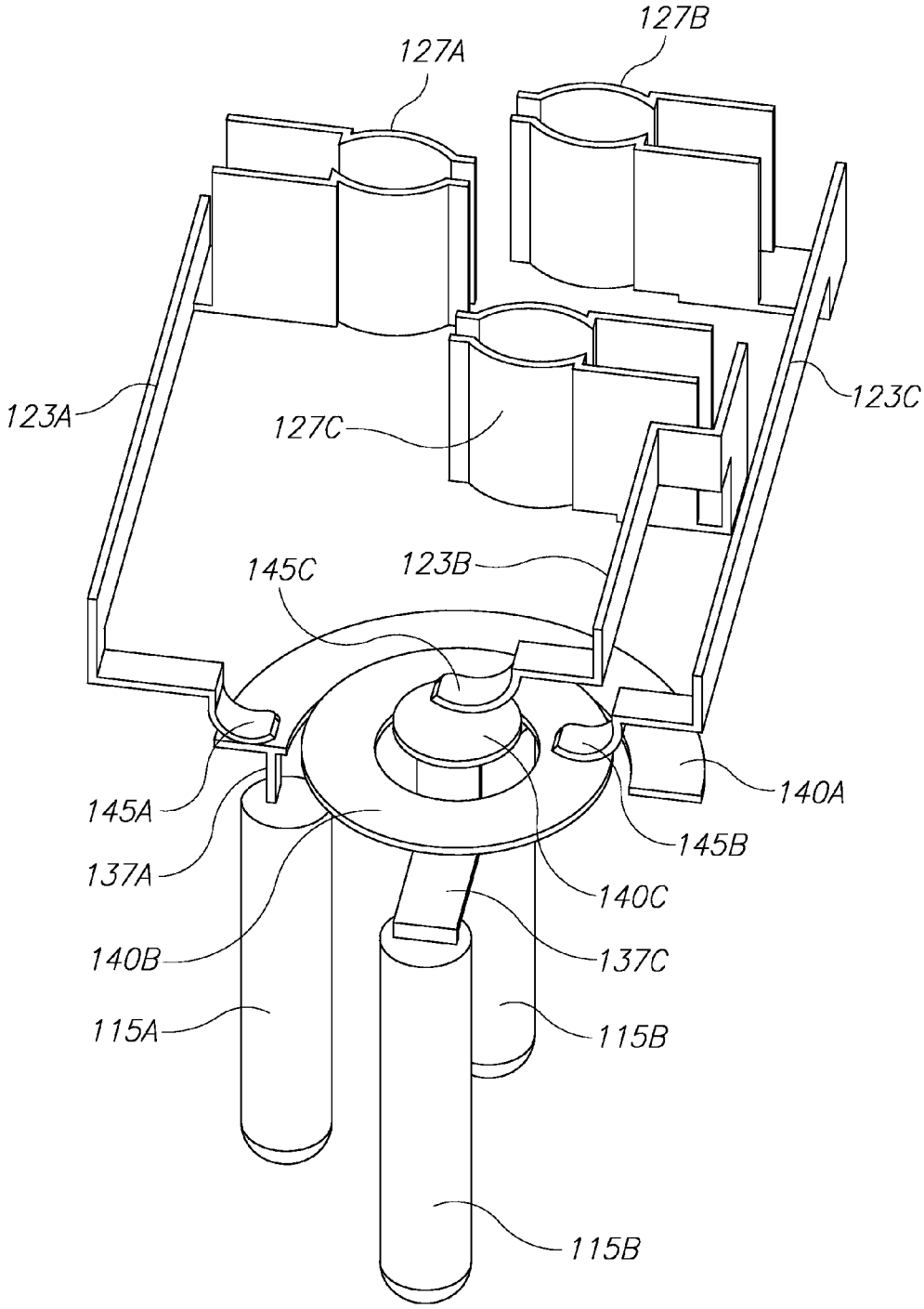
FIG. 20 is a perspective view of a part of the mechanism in an electric connector, according to some embodiments of the invention.

Each wired contact 123 comprises contact connection 145 (145A, 145B, 145C) to corresponding track 140 that maintain electric contact during the rotation of tracks 140 (FIG. 20). Contact connections 145 may be mounted in housing 130 such as to apply a pressure on the respective tracks 140, to yield continuous electrical contact therewith. For example, the ends of contact connections 145 may be bent or preloaded to push against tracks 140.

Conductive tracks 140 may be made of copper, and may be flat, or have a convex profile towards the respective contact connection 145 and arranged to ensure continuous contact.

Conductive tracks 140 may be connected to pins 115 by contacts 137 (137A, 137B, 137C, FIG. 20) extending from each track 140 to corresponding pin 115 (e.g. inwards when track 140 encircle pins 115).

Method 200 enables a rotation of a plug within a housing of an electric connector. Method 200 may comprise the following stages: connecting each pin of the plug with a conductive track positioned within the housing and concentric with the plug, connecting the plug with the conductive tracks to the housing such as to allow their rotation within the housing, connecting each socket slot of the electric connector to a contact connection, and movably connecting each contact connection to the corresponding conductive track such as to maintain electric contact during the rotation of the tracks.

Electric connector 100 allows rotating housing 130 in respect to plug 110 at any user specified angle while maintaining the connector functionality.

Embodiments of electric connector 100 may be designed to comply with any standard, as the exact ordering of pins 115 and slots 121 does not interfere with the transmission of current between tracks 140 and connections 145.

Electric connector 100 is designed to provide maximal usage safety. For example, tracks 140 as well as contact connections 145 are supported and fixated by the housing protrusions or plug support 112, and the continuous contact between tracks 140 and contact connections 145 is ensured by stabilizing contact connections 145 within tracks 140.

To summarize, electric connector 100 connects one plug 110 with several sockets 120 in housing 130, arrange to allow rotating plug 110 relative to housing 130, while keeping connector 100 functional. Plug pins 115 are connected to conducting tracks 140 that are allowed to rotate with plug 110 within housing 130. Conducting tracks 140 are positioned within housing 130 coaxially at different heights 141 and have different diameters 142, such that lowest track 140B (most remote from plug 110) has the smallest diameter 142B, and diameter 142 decreases monotonously towards plug 110. Contacts 123 behind slots 121 of sockets 120 contact tracks 140 via contact connections 145 that are positioned such as to maintain continuous contact with the corresponding tracks 140.

Tracks 140 and contact connections 145 are supported and secured by protrusions within housing 130, e.g. as support 112. Association of tracks 140 with pins 115 and the association of contact connections 145 with wired contacts 123 may be selected and appropriately constructed within housing 130 at will.

Tracks 140 may be flat, and contact connections 145 contact tracks 140 on their flat sides. Furthermore, the contact is not necessarily facilitated by support 112. Finally, tracks 140 may have a decreasing diameter from the plug inwards.

Figure 21:
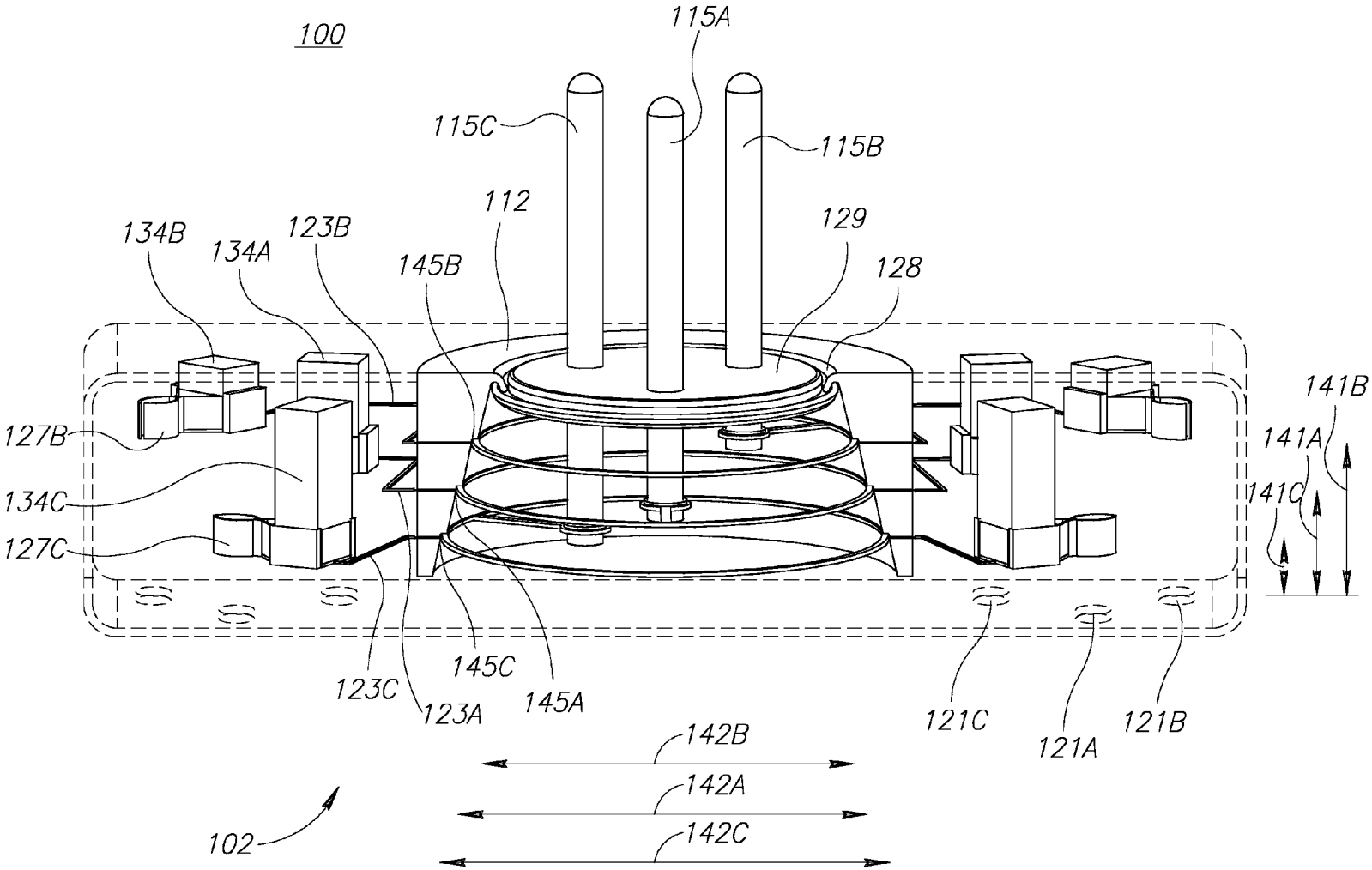
FIGS. 21 and 22 are schematic illustrations of an electric connector, according to some embodiments of the invention.
Figure 22:
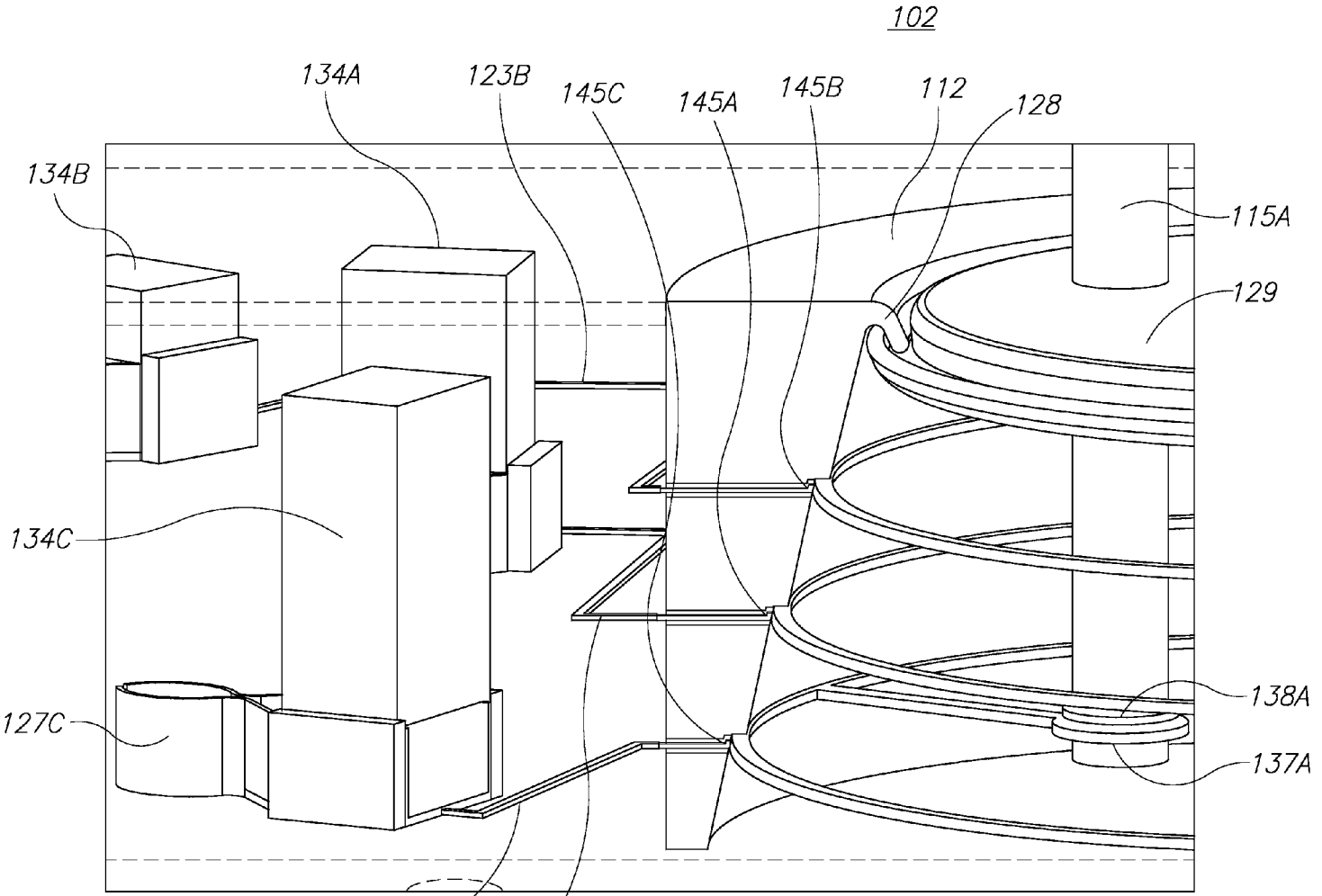

FIGS. 21 and 22 are schematic illustrations of an electric connector 100, according to some embodiments of the invention. FIG. 21 is a perspective view with a transparent housing, FIG. 22 presents a detailed view 102.

Electric connector 100 comprises a plug 110 having at least two pins 115C (e.g. live), 115B (e.g. neutral), 115A (e.g. earth), and a housing 130 having at least one socket 120 at a housing basis 130B. Housing 130 may comprise one socket 120, two or three sockets 120 or more. Each socket 120 has at least two slots 121C (e.g. live), 121B (e.g. neutral), 121A (e.g. earth). Each slot 121 (121A, 121B, 121C) corresponds to one of pins 115 (121A to 115A, 121B to 115B and 115C to 121C) and connected to a wired contact 123 within housing 130.

Figure 19:
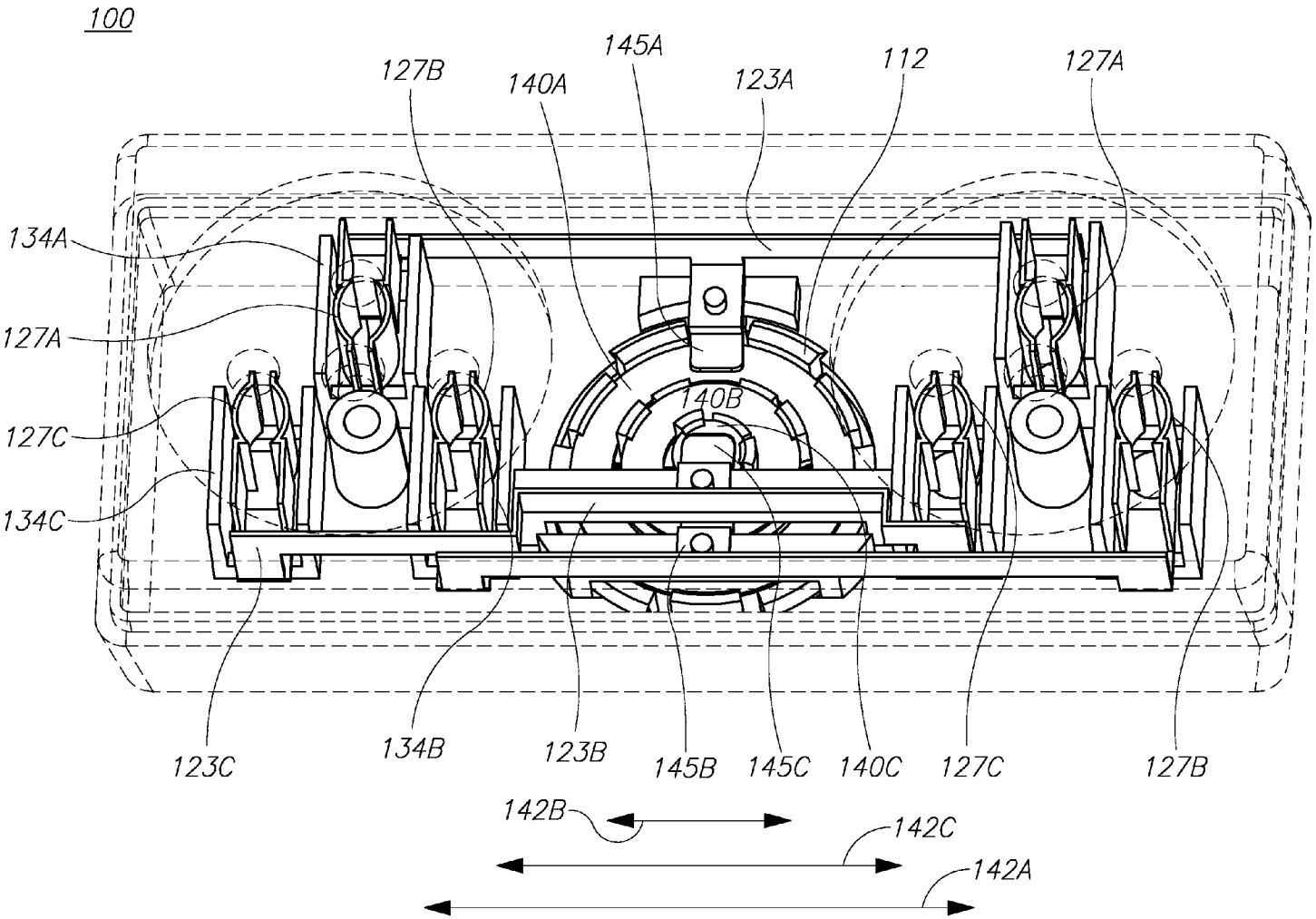
FIG. 19 is a schematic transparent perspective illustration of the inner workings of an electric connector, according to some embodiments of the invention.

Each pin 115 is connected to an annular conductive track 140 that is parallel to a housing basis 130B and supported within housing 130 by housing protrusions (not shown), such that each track 140 (140A, 140B, 140C) is positioned at a specified height 141 (141A, 141B, 141C) in respect to housing basis 130B within housing 130. The housing protrusions may be integrated into a plug support 112 (as illustrated in FIGS. 18 and 19) such as to support tracks 140 during their rotation.

Connection to slots 121 (121A, 121B, 121C) is achieved via contacts 127 (127A, 127B, 127C respectively), connected to wired contacts 123 (123A, 123B, 123C respectively), which are in turn connected via contact connections 145 (123A, 123B, 123C respectively) to conductive tracks 140. Contact connections 145 may be inserted through plug support 112 to contact the corresponding annular conductive tracks 140 at their outer edges. Plug support 112 may be arranged to stabilize plug 110 and annular conductive tracks 140 within housing 130 and during their rotation.

Annular tracks 140 are concentric and have a decreasing diameter 142 (142A, 142B, 142C) from the lowest (140C) to the highest (140A) track 140 in respect to housing basis 130B.

The association between tracks 140 and the function of each track 140 and pin 115 may be selected at will. The illustrated association of C-live, B-neutral, A-earth is arbitrary and may be replaced by any configuration, with the appropriate structural changes.

Plug 110 with pins 115 and annular conductive tracks 140 is coaxially rotatable in respect to housing 130. Plug support 112 of plug 110 is arranged to support annular conductive tracks 140 while they rotate within a mechanical socket 129 of housing 130. An edge 128 of plug support 112 may engage into a channel within mechanical socket 129 (FIG. 22, view 102).

Each wired contact 123 comprises contact connection 145 (145A, 145B, 145C) to corresponding track 140 that maintain electric contact during the rotation of tracks 140. Contact connections 145 may be mounted in housing 130 such as to apply a pressure on the respective tracks 140, to yield continuous electrical contact therewith. For example, the ends of contact connections 145 may be bent or preloaded to push against tracks 140.

Contact connections 145 may be inserted through plug support 112 to contact the corresponding annular conductive tracks 140 at their outer edges. The ends of contact connections 145 may be bent and pressed between tracks 140 and plug support 112.

Annular conductive tracks 140 may be made of copper, and may have a concave profile towards the respective contact connection 145 and arranged to partially enclose the respective contact connection 145.

Annular conductive tracks 140 may be connected to pins 115 by contacts 137 (137A, 137B, 137C) extending from each track 140 to corresponding pin 115 (e.g. inwards when track 140 encircle pins 115). The actual connection of contacts 137 to pins 115 may be accomplished by a ring end of contact 137 surrounding pin 115 and supported by a support 138 (138A, 138B, 138C).

Method 200 of enabling a rotation of a plug within a housing of an electric connector may comprise the following stages: connecting each pin of the plug with an annular conductive track positioned within the housing and concentric with the plug, connecting the plug with the annular conductive tracks to the housing such as to allow their rotation within the housing, connecting each socket slot of the electric connector to a contact connection, and movable connecting each contact connection to the corresponding annular conductive track such as to maintain electric contact during the rotation of the tracks.

Electric connector 100 allows rotating housing 130 in respect to plug 110 at any user specified angle while maintaining the connector functionality.

Embodiments of electric connector 100 may be designed to comply with any standard, as the exact ordering of pins 115 and slots 121 does not interfere with the transmission of current between tracks 140 and connections 145.

Electric connector 100 is designed to provide maximal usage safety. For example, tracks 140 as well as contact connections 145 are supported and fixated by the housing protrusions or plug support 112, and the continuous contact between tracks 140 and contact connections 145 is ensured by stabilizing contact connections 145 within tracks 140.

To summarize, electric connector 100 connects one plug 110 with several sockets 120 in housing 130, arrange to allow rotating plug 110 relative to housing 130, while keeping connector 100 functional. Plug pins 115 are connected to annular tracks 140 that are allowed to rotate with plug 110 within housing 130. Annular tracks 140 are positioned within housing 130 coaxially at different heights 141 and have different diameters 142, such that lowest track 140A (most remote from plug 110) has the largest diameter 142A, and diameter 142 decreases monotonously towards plug 110. Contacts 123 behind slots 121 of sockets 120 contact tracks 140 via contact connections 145 that are positioned such as to maintain continuous contact with the corresponding tracks 140, e.g. by pressing them against track 140 and curving the track's profile to hold the ends of contact connections 145. Tracks 140 and contact connections 145 are supported and secured by protrusions within housing 130. Association of tracks 140 with pins 115 and the association of contact connections 145 with wired contacts 123 may be selected and appropriately constructed within housing 130 at will. Track 140 and plug 110 may be supported by plug support 112, and contact connections 145 may pass through plug support 112 and be pressed against tracks 140.

In the above description, an embodiment is an example or implementation of the invention. The various appearances of "one embodiment", "an embodiment" or "some embodiments" do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Furthermore, it is to be understood that the invention can be carried out or practiced in various ways and that the invention can be implemented in embodiments other than the ones outlined in the description above.

The invention is not limited to those diagrams or to the corresponding descriptions. For example, flow need not move through each illustrated box or state, or in exactly the same order as illustrated and described.

Meanings of technical and scientific terms used herein are to be commonly understood as by one of ordinary skill in the art to which the invention belongs, unless otherwise defined.

While the invention has been described with respect to a limited number of embodiments, these should not be construed as limitations on the scope of the invention, but rather as exemplifications of some of the preferred embodiments. Other possible variations, modifications, and applications are also within the scope of the invention.

What is claimed is:

1. A method of changing a position of at least one socket with respect to a plug of an electric connector, the method comprising the steps of:

providing the electric connector, wherein the electrical connector comprising:

a plug having at least two pins and a housing having at least one socket at a housing base, the socket having at least two slots therein, wherein the plug is coaxially rotatable in respect to the housing, whereby, using a contact connection, each pin is connected to a round flat track;

wherein the contact connection is circularly movable along the round flat track upon rotation of the plug within the housing;

wherein each round flat track is connected to a corresponding wired contact, whereby each wired contact is slidably enclosed within a corresponding linear track that is connected via a corresponding strap to a corresponding slot; and the housing further comprises a guiding plate positioned between the round flat tracks and the linear tracks and comprising a corresponding slit for each wired contact, wherein the plug is slidably movable along the guiding plate with the wired contacts moving through the slits and continuously contacting the linear tracks; and sliding the plug along the slits, rotating the plug with respect to the housing, thereby changing the position of the socket with respect to the plug.

2. The method of claim 1, wherein the electric connector comprises more than one socket.

3. The method of claim 2, wherein the electric connector comprises two to six sockets.

4. The method of claim 3, wherein the electric connector comprises three sockets arranged linearly.

5. The method of claim 3, wherein the electric connector comprises four sockets arranged linearly or two-by-two.

6. The method of claim 1, wherein the contact straps are connected to the linear tracks via a horizontal flat arc disposed in parallel to corresponding strap.

7. The method of claim 6, wherein the electric connector comprises three to six sockets.

* * * * *